US009343220B2

(12) United States Patent
Kim et al.

(10) Patent No.: US 9,343,220 B2
(45) Date of Patent: May 17, 2016

(54) PLANAR TRANSFORMER

(71) Applicants: LG INNOTEK CO., LTD., Seoul (KR); JEONJU UNIVERSITY OFFICE OF INDUSTRYUNIVERSITY COOPERATION, Jeonju (KR)

(72) Inventors: Eun Soo Kim, Jeonju (KR); Bong Geun Chung, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 14/639,569

(22) Filed: Mar. 5, 2015

(65) Prior Publication Data

US 2015/0200047 A1 Jul. 16, 2015

Related U.S. Application Data

(63) Continuation of application No. 13/702,038, filed as application No. PCT/KR2011/004095 on Jun. 3, 2011, now Pat. No. 9,000,874.

(30) Foreign Application Priority Data

Jun. 4, 2010 (KR) ..... 10-2010-0052949

(51) Int. Cl.

| | |
|---|---|
| ***H01F 5/00*** | (2006.01) |
| ***H01F 27/24*** | (2006.01) |
| ***H01F 3/14*** | (2006.01) |
| ***H01F 38/08*** | (2006.01) |
| ***H01F 27/28*** | (2006.01) |
| ***H01F 27/26*** | (2006.01) |
| ***H01F 27/30*** | (2006.01) |

(52) U.S. Cl.

CPC ..... *H01F 27/24* (2013.01); *H01F 3/14* (2013.01); *H01F 5/00* (2013.01); *H01F 27/263* (2013.01); *H01F 27/2804* (2013.01); *H01F 27/306* (2013.01); *H01F 38/08* (2013.01)

(58) Field of Classification Search

CPC ..... H01F 5/00; H01F 27/00–27/30
USPC ..... 336/65, 83, 200, 232
See application file for complete search history.

(56) References Cited

U.S. PATENT DOCUMENTS 5,010,314 A 4/1991 Estrov
6,000,128 A 12/1999 Umeno et al.

(Continued)

FOREIGN PATENT DOCUMENTS

JP 05-090929 U 12/1993
JP 2000-068132 A 3/2000

(Continued)

OTHER PUBLICATIONS

Office Action dated Apr. 22, 2015 in Taiwanese Application No. 103138213.

(Continued)

*Primary Examiner* — Tuyen Nguyen
(74) *Attorney, Agent, or Firm* — Saliwanchik, Lloyd & Eisenschenk

(57) ABSTRACT

Disclosed is a planar transformer including a first planar core which is formed of a magnetic substance, a lower secondary winding which is disposed to enclose a first left sill of the first planar core between a first rear sill and a first front sill of the first planar core; a primary winding which is disposed on the lower secondary winding so as to enclose first left and right sills of the first planar core; an upper secondary winding which is disposed on the primary winding to enclose the first left sill of the first planar core; and a second planar core disposed on the upper secondary winding.

17 Claims, 18 Drawing Sheets

(56) References Cited

U.S. PATENT DOCUMENTS

| | | | |
|---|---|---|---|
| 6,867,678 | B2 | 3/2005 | Yang |
| 7,633,369 | B2 | 12/2009 | Chandrasekaran et al. |
| 7,872,561 | B2 | 1/2011 | Matumoto |
| 7,907,042 | B2 | 3/2011 | Kawasaki et al. |
| 2008/0101097 | A1 | 5/2008 | Kawasaki et al. |

FOREIGN PATENT DOCUMENTS

| | | | |
|---|---|---|---|
| JP | 2001035731 | A | 2/2001 |
| JP | 2002-057045 | A | 2/2002 |
| JP | 2004-297862 | A | 10/2004 |
| JP | 2008-113532 | A | 5/2008 |
| JP | 2010-050160 | A | 3/2010 |

OTHER PUBLICATIONS

International Search Report in International Application No. PCT/KR2011/004095, filed Jun. 3, 2011.

European Search Report dated Oct. 11, 2013 in European Application No. 13168557.0, filed Jun. 3, 2011.

Office Action in Taiwanese Application No. 100119554, dated Jun. 9, 2014.

PLANAR TRANSFORMER

CROSS-REFERENCE TO RELATED APPLICATIONS

This application is a continuation of U.S. application Ser. No. 13/702,038, filed Apr. 25, 2013, which is the U.S. national stage application of International Patent Application No. PCT/KR2011/004095, filed Jun. 3, 2011, which claims priority to Korean Patent Application No. 10-2010-0052949, filed Jun. 4, 2010, which are herein incorporated by reference in their entirety.

BACKGROUND

1. Technical Field

The present invention relates to a planar transformer.

2. Background of Invention

Recently, a power supplying device using an SMPS (Switching Mode Power Supply) has received attention. The SMPS functions to stably supply power using a transformer and a switching device such as MOS FET (Metal Oxide Semiconductor Field Effect Transistor) and BJT (Bipolar Junction Transistor).

Meanwhile, as there is a tendency that home appliances are developed to be lighter and leaner, the SMPS is also required to be slim. A planar transformer is used widely in order to reduce the size of the transformer larger than any other circuit components of the SMPS.

However, since a conventional planar transformer used in an LCC resonant converter has a small leakage inductance, it is necessary to separately provide a leakage inductor at the outside thereof or separately use a core having a small magnetic permeability. Thus, there is a problem that a volume of the planar transformer becomes larger, or it becomes more complex to manufacture the planar transformer.

DISCLOSURE OF INVENTION

Technical Problem

An object of the present invention is to provide a planar transformer which can sufficiently secure the leakage inductance in the planar transformer free from a separate core having a small magnetic permeability or providing a leakage inductor at outside.

Solution to Problem

To achieve the object of the present invention, a first embodiment of the present invention provides a planar transformer, comprising: a first planar core including a first main body which is formed of a magnetic substance, a first rear sill which is formed at a left rear long side of the first main body, a second rear sill which is formed at a right rear long side of the first main body, a first front sill which is formed at a left front long side of the first main body, a second front sill which is formed at a right front long side of the first main body, a first left sill which is formed at a center portion between the first rear sill and the first front sill, and a first right sill which is formed at a center portion between the second rear sill and the second front sill so as to be spaced apart from the first left sill; a lower secondary winding which is disposed to enclose the first left sill of the first planar core between the first rear sill and the first front sill of the first planar core; a primary winding which is disposed on the lower secondary winding 1 so as to enclose the first left and right sills of the first planar core; an upper secondary winding which is disposed on the primary winding to enclose the first left sill of the first planar core; and a second planar core disposed on the upper secondary winding and including a second main body which is formed of a magnetic substance, a third rear sill which is formed at a left rear long side of the second main body, a fourth rear sill which is formed at a right rear long side of the second main body, a third front sill which is formed at a left front long side of the second main body, a fourth front sill which is formed at a right front long side of the second main body, a second left sill which is formed at a center portion between the third rear sill and the third front sill, and a second right sill which is formed at a center portion between the fourth rear sill and the fourth front sill so as to be spaced apart from the second left sill.

A second embodiment of the present invention provides a planar transformer, comprising: a first planar core including a main body which is formed of a magnetic substance, a first rear sill which is formed at a left rear long side of the main body, a second rear sill which is formed at a right rear long side of the main body, a first front sill which is formed at a left front long side of the main body, a second front sill which is formed at a right front long side of the main body, a left sill which is formed at a center portion between the first rear sill and the first front sill, and a right sill which is formed at a center portion between the second rear sill and the second front sill so as to be spaced apart from the left sill; a lower secondary winding which is disposed to enclose the left sill of the first planar core between the first rear sill and the first front sill of the first planar core; a primary winding which is disposed on the lower secondary winding so as to enclose the left and right sills of the first planar core; an upper secondary winding which is disposed on the primary winding to enclose the left sill of the first planar core; and a second planar core which is formed of a magnetic substance, and disposed on the upper secondary winding and the primary winding.

A third embodiment of the present invention provides a planar transformer, comprising: a first planar core including a first main body which is formed of a magnetic substance, a first rear sill which is formed at a left rear long side of the first main body, a second rear sill which is formed at a right rear long side of the first main body, a first front sill which is formed at a left front long side of the first main body, a second front sill which is formed at a right front long side of the first main body, a first left short which is formed at a center portion between the first rear sill and the first front sill, and a first right sill which is formed at a center portion between the second rear sill and the second front sill so as to be spaced apart from the first left sill; a lower secondary winding which is disposed to enclose the first left sill of the first planar core between the first rear sill and the first front sill of the first planar core; a primary winding which is disposed on the lower secondary winding so as to enclose the first 2 left and right sills of the first planar core; an upper secondary winding which is disposed on the primary winding to enclose the first left sill of the first planar core; and a second left planar core disposed on the upper secondary winding, and comprising a twenty-first main body which is formed of a magnetic substance, a third rear sill which is formed at a rear long side of the twenty-first main body so as to be opposed to the first rear sill of the first planar core, a third front sill which is formed at a front long side of the twenty-first main body so as to be opposed to the first front sill of the first planar core, a second left sill which is formed at a center portion between the third rear sill and the third front sill so as to be opposed to the first left sill of the first planar core; and a second right planar core disposed on the primary winding so as to be spaced apart from the second left planar core, and comprising a twenty-second main body which is formed of a magnetic substance, a twenty-second rear sill which is formed at a rear long side of the twenty-second main body so as to be opposed to the second rear sill of the first planar core, a fourth front sill which is formed at a front long side of the twenty-second main body so as to be opposed to the second front sill of the first planar core, a second right sill which is formed at a center portion between the fourth rear sill and the fourth front sill so as to be opposed to the first right sill of the first planar core.

A fourth embodiment of the present invention provides a planar transformer, comprising: a first planar core including a first main body which is formed of a magnetic substance, a first rear sill which is formed at a left rear long side of the first main body, a second rear sill which is formed at a right rear long side of the first main body, a first front sill which is formed at a left front long side of the first main body, a second front sill which is formed at a right front long side of the first main body, a first left sill which is formed at a center portion between the first rear sill and the first front sill, and a first right sill which is formed at a center portion between the second rear sill and the second front sill so as to be spaced apart from the first left sill; a lower secondary winding which is disposed to enclose the first left sill of the first planar core between the first rear sill and the first front sill of the first planar core; a primary winding which is disposed on the lower secondary winding so as to enclose the first left and right sills of the first planar core; an upper secondary winding which is disposed on the primary winding to enclose the first left sill of the first planar core; a second left planar core which is formed of a magnetic substance and disposed on the upper secondary winding so as to be opposed to the first rear sill, the first front sill and the first left sill of the first planar core; and a second right planar core which is formed of a magnetic substance and disposed on the primary winding, and disposed to be spaced apart from the second left planar core and also to be opposed to the second rear sill, the second front sill and the first right sill of the first planar core.

A fifth embodiment of the present invention provides a planar transformer, comprising: a first left planar core including an eleventh main body which is formed of a magnetic substance, a first rear sill which is formed at a rear long side of the eleventh main body, a first front sill which is formed at a front long side of the eleventh main body, and a first left sill which is formed at a center portion between the first rear sill and the first front sill; a first right planar core disposed to be spaced apart from the first left planar core and comprising a twelfth main body which is formed of a magnetic substance, a second rear sill which is formed at a rear long side of the twelfth main body, a second front sill which is formed at a front long side of the twelfth main body, and a first right sill which is formed at a center portion between the second rear sill and the second front sill; a lower secondary winding which is disposed to enclose the first left sill of the first left planar core between the first rear sill and the first front sill of the first left planar core; a primary winding which is disposed on the lower secondary winding so as to enclose the first left sill of the first left planar core and the first right sills of the first right planar core; an upper secondary winding which is disposed on the primary winding to enclose the first left sill of the first left planar core; a second left planar core disposed on the upper secondary winding and comprising a twenty-first main body which is formed of a magnetic substance, a third rear sill which is formed at a rear long side of the twenty-first main body and also to be opposed to the first rear sill of the first left planar core, a third front sill which is formed at a front long side of the twenty-first main body and also to be opposed to the first front sill of the first left planar core, and a second left sill which is formed at a center portion between the third rear sill and the third front sill so as to be opposed to the first left sill of the first planar core; and a second right planar core disposed on the primary winding so as to be spaced apart from the second left planar core, and comprising a twenty-second main body which is formed of a magnetic substance, a fourth rear sill which is formed at a rear long side of the twenty-second main body and also to be opposed to the second rear sill of the first right planar core, a fourth front sill which is formed at a front long side of the twenty-second main body and also to be opposed to the second front sill of the first right planar core, and a second right sill which is formed at a center portion between the fourth rear sill and the fourth front sill so as to be opposed to the first right sill of the first right planar core.

A sixth embodiment of the present invention provides a planar transformer, comprising: a first left planar core including an eleventh main which is formed of a magnetic substance, a first rear sill which is formed at a rear long side of the eleventh main body, a first front sill which is formed at a front long side of the eleventh main body, and a first left sill which is formed at a center portion between the first rear sill and the first front sill; a first right planar core disposed to be spaced apart from the first 4 left planar core and comprising a twelfth main body which is formed of a magnetic substance, a second rear sill which is formed at a rear long side of the twelfth main body, a second front sill which is formed at a front long side of the twelfth main body, and a first right sill which is formed at a center portion between the second rear sill and the second front sill; a lower secondary winding which is disposed to enclose the first left sill of the first left planar core between the first rear sill and the first front sill of the first left planar core; a primary winding which is disposed on the lower secondary winding so as to enclose the first left sill of the first left planar core and the first right sills of the first right planar core; an upper secondary winding which is disposed on the primary winding to enclose the first left sill of the first left planar core; a second left planar core which is formed of a magnetic substance and disposed on the upper secondary winding so as to be opposed to the first rear sill, the first front sill and the first left sill of the first left planar core; and a second right planar core which is formed of a magnetic substance and disposed on a primary winding so as to be spaced apart from the second left planar core and also to be opposed to the second rear sill, the second front sill and the right sill of the first right planar core.

A seventh embodiment of the present invention provides a planar transformer, comprising: a first planar core including a first main body which is formed of a magnetic substance, a first rear sill which is formed at a left rear long side of the first main body, a second rear sill which is formed at a right rear long side of the first main body, a first front sill which is formed at a left front long side of the first main body, a second front sill which is formed at a right front long side of the first main body, a first left sill which is formed at a center portion between the first rear sill and the first front sill, a first right sill which is formed at a center portion between the second rear sill and the second front sill so as to be spaced apart from the first left sill, and a first vent hole which is formed between the first left sill and the first right sill and through which air is ventilated to an outside; a lower secondary winding which is disposed to enclose the first left sill of the first planar core between the first rear sill and the first front sill of the first planar core; a primary winding which is disposed on the lower secondary winding so as to enclose the first left and right sills of the first planar core; an upper secondary winding which is disposed on the primary winding to enclose the first left sill of the first planar core; and a second planar core disposed on the upper secondary winding and including a second main body which is formed of a magnetic substance, a third rear sill which is formed at a left rear long side of the second main body, a fourth rear sill which is formed at a right rear long side of the second main body, a third front sill which is formed at a left front long side of the second main body, a fourth front sill which is formed at a right front long side of the second main body, a second left sill which is formed at a center portion between the third rear sill and the third front sill, a second right sill which is formed at a center portion between the fourth rear sill and the fourth front sill so as to be spaced apart from the second left sill.

A eighth embodiment of the present invention provides a planar transformer, comprising: a first planar core including a first main body which is formed of a magnetic substance, a first rear sill which is formed at a left rear long side of the first main body, a second rear sill which is formed at a right rear long side of the first main body, a first front sill which is formed at a left front long side of the first main body, a second front sill which is formed at a right front long side of the first main body, a first left sill which is formed at a center portion between the first rear sill and the first front sill, and a first right sill which is formed at a center portion between the second rear sill and the second front sill so as to be spaced apart from the first left sill; a lower secondary winding which is disposed to enclose the first left sill of the first planar core between the first rear sill and the first front sill of the first planar core; a primary winding which is disposed on the lower secondary winding so as to enclose the first left and right sills of the first planar core; an upper secondary winding which is disposed on the primary winding to enclose the first left sill of the first planar core; and a second planar core disposed on the upper secondary winding and comprising a second main body which is formed of a magnetic substance, a third rear sill which is formed at a left rear long side of the second main body, a fourth rear sill which is formed at a right rear long side of the second main body, a third front sill which is formed at a left front long side of the second main body, a fourth front sill which is formed at a right front long side of the second main body, a second left sill which is formed at a center portion between the third rear sill and the third front sill, a second right sill which is formed at a center portion between the fourth rear sill and the fourth front sill so as to be spaced apart from the second left sill, and a second vent hole which is formed between the second left sill and the second right sill and through which air is ventilated to an outside.

A ninth embodiment of the present invention provides a planar transformer, comprising: a first planar core including a first main body which is formed of a magnetic substance, a first rear sill which is formed at a left rear long side of the first main body, a second rear sill which is formed at a right rear long side of the first main body, a first front sill which is formed at a left front long side of the first main body, a second front sill which is formed at a right front long side of the first main body, a first left sill which is formed at a center portion between the first rear sill and the first front sill, a first right sill which is formed at a center portion between the second rear sill and the second front sill so as to be spaced apart from the first left sill, and a first vent hole which is formed between the first left sill and the first right sill and through which air is ventilated to an outside; a lower secondary winding which is disposed to enclose the first left sill of the first planar core between the first rear sill and the first front sill of the first planar core; a primary winding which is disposed on the lower secondary winding so as to enclose the first left and right sills of the first planar core; an upper secondary winding which is disposed on the primary winding to enclose the first left sill of the first planar core; a second planar core disposed on the upper secondary winding and comprising a second main body which is formed of a magnetic substance, a third rear sill which is formed at a left rear long side of the second main body, a fourth rear sill which is formed at a right rear long side of the second main body, a third front sill which is formed at a left front long side of the second main body, a fourth front sill which is formed at a right front long side of the second main body, a second left sill which is formed at a center portion between the third rear sill and the third front sill, a second right sill which is formed at a center portion between the fourth rear sill and the fourth front sill so as to be spaced apart from the second left sill, and a second vent hole which is formed between the second left sill and the second right sill and through which air is ventilated to an outside.

Advantageous Effects of Invention

As described above, in the planar transformer according to the embodiments of the present invention, as described above, since it is possible to effectively secure and control the surface area of the portion that the secondary winding is not interlinked with the primary winding, it can secure a sufficient leakage inductance therein without using a separate core having a small magnetic permeability or providing a separate leakage inductor at the outside thereof.

BRIEF DESCRIPTION OF DRAWINGS

The above and other objects, features and advantages of the present invention will become apparent from the following description of preferred embodiments given in conjunction with the accompanying drawings, in which.

MODE FOR THE INVENTION

Figure 1:
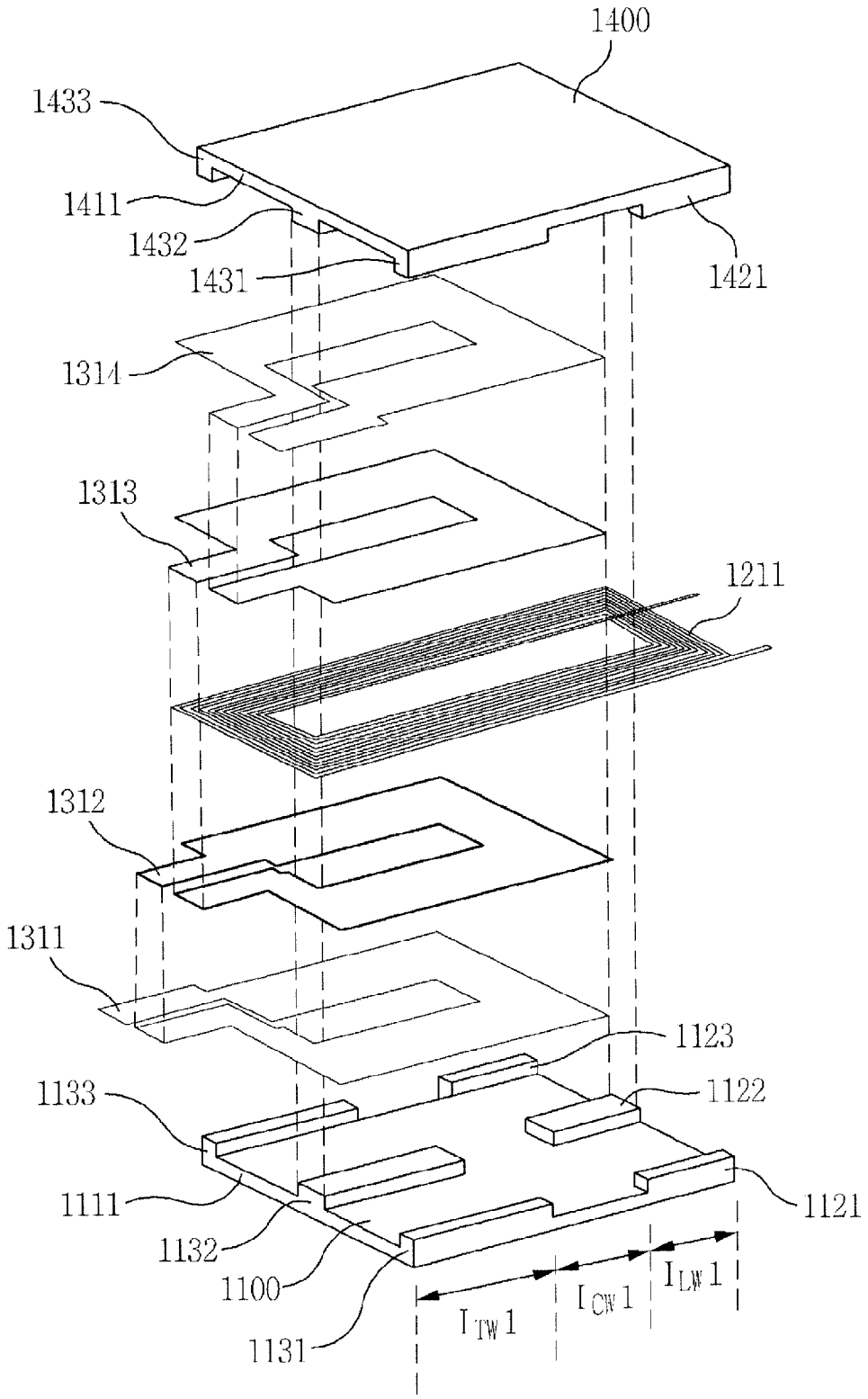
FIG. 1 is an exploded perspective view of a planar transformer according to a first embodiment of the present invention.

Hereinafter, the embodiments of the present invention will be described in detail with reference to accompanying drawings. Herein, sizes and shapes of construction elements shown in the drawings may be exaggeratedly illustrated for the sake of convenience and clarity. Furthermore, the terms defined considering the construction and effect of the present invention may be varied according to the custom or purpose of a user and an operator. The definition of terms should be based on the overall description of the present invention.

Figure 2:
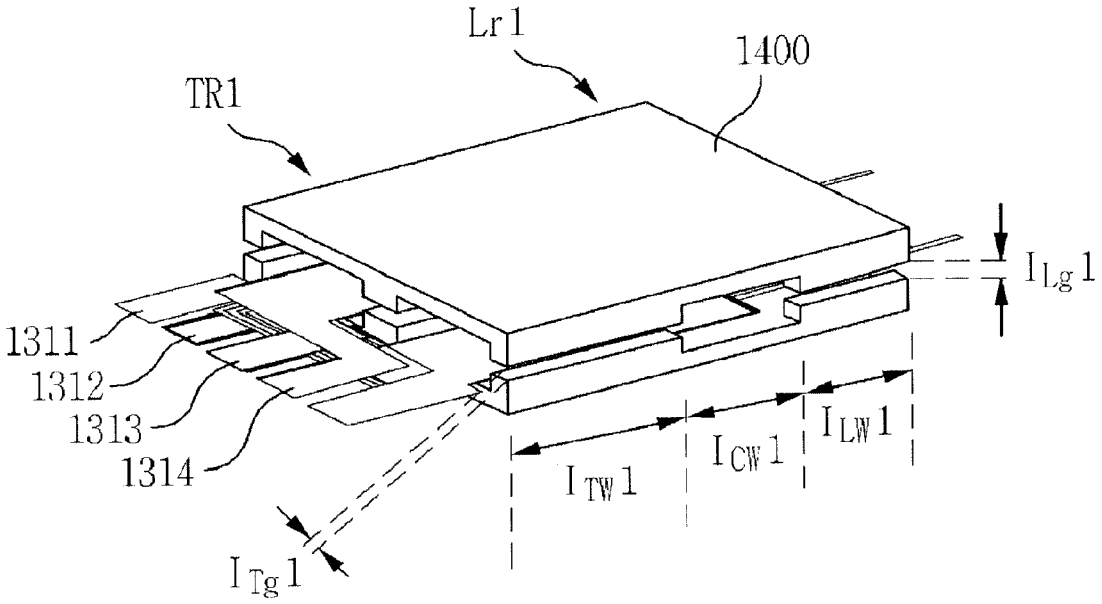
FIG. 2 is a perspective view of the planar transformer according to the first embodiment of the present invention.

FIG. 1 is an exploded perspective view of a planar transformer according to a first embodiment of the present invention, and FIG. 2 is a perspective view of the planar transformer according to the first embodiment of the present invention.

Referring to FIGS. 1 and 2, a first planar core 1100 includes a first main body 1111 which is formed of a rectangular magnetic substance, a first rear sill 1133 which is formed to be extended at a left rear long side of the first main body 1111, a second rear sill 1123 which is formed to be extended at a right rear long side of the first main body 1111, a first front sill 1131 which is formed to be extended at a left front long side of the first main body 1111, a second front sill 1121 which is formed to be extended at a right front long side of the first main body 1111, a first left sill 1132 which is formed at a center portion between the first rear sill 1133 and the first front sill 1131 so as to have a desired length, and a first right sill 1122 which is formed at a center portion between the second rear sill 1123 and the second front sill 1121 so as to have a desired length and also which is spaced apart from the first left sill 1132. In the first planar core 1100, the first rear sill 1133, the second rear sill 1123, the first front sill 1131, the second front sill 1121, the first left sill 1132 and the first right sill 1122 may be integrally formed with the first main body 1111.

Meanwhile, the first main body 1111 may be formed of various-shaped magnetic substances such as a rectangular magnetic substance, a square magnetic substance, an elliptical magnetic substance and a circular magnetic substance according to electronic products in which the first main body 1111 is used.

A lower secondary winding 1311, 1312 formed by stacking a plurality of coils is disposed to enclose the first left sill 1132 of the first planar core 1100 between the first rear sill 1133 and the first front sill 1131 of the first planar core 1100.

A primary winding 1211 formed into a rectangular shape having a plurality of wound coils is disposed on the lower secondary winding 1311, 1312 so as to enclose the first left and right sills 1132 and 1122 of the first planar core 1100.

An upper secondary winding 1313, 1314 formed by stacking a plurality of coils is disposed on the primary winding 1211 to enclose the first left sill 1132 of the first planar core 1100.

A second planar core 1400 is disposed on the upper secondary winding 1313, 1314. The second planar core 1400 includes a second main body 1411 which is formed of a rectangular magnetic substance, a third rear sill 1433 which is formed to be extended at a left rear long side of the second main body 1411, a fourth rear sill 1423 which is formed to be extended at a right rear long side of the second main body 1411, a third front sill 1431 which is formed to be extended at a left front long side of the second main body 1411, a fourth front sill 1421 which is formed to be extended at a right front long side of the second main body 1411, a second left sill 1432 which is formed at a center portion between the third rear sill 1433 and the third front sill 1431 so as to have a desired length, and a second right sill 1422 which is formed at a center portion between the fourth rear sill 1423 and the fourth front sill 1421 so as to have a desired length and also which is spaced apart from the second left sill 1432. In the second planar core 1400, the third rear sill 1433, the fourth rear sill 1423, the third front sill 1431, the fourth front sill 1421, the second left sill 1432 and the second right sill 1422 may be integrally formed with the second main body 1411. Meanwhile, the second main body 1411 may be formed of various-shaped magnetic substances such as a rectangular magnetic substance, a square magnetic substance, an elliptical magnetic substance and a circular magnetic substance according to electronic products in which the second main body 1411 is used.

In the planar transformer according to the first embodiment of the present invention, as shown in FIG. 2, a transformer TR1 is formed at an overlapped portion of the first planar core 1100, the lower secondary winding 1311, 1312, the primary winding 1211, the upper second winding 1313, 1314 and the second planar core 1400, and a leakage inductor Lr1 is formed at an overlapped portion of the first planar core 1100, the primary winding 1211 and the second planar core 1400.

On the other hand, it is necessary to insulate between the first planar core 1100 and the lower secondary winding 1311, 1312, between the lower secondary winding 1311, 1312 and the primary winding 1211, between the primary winding 1211 and the upper secondary winding 1313, 1314, between the upper secondary winding 1313, 1314 and the second planar core 1400, and between the primary winding 1211 and the second planar core 1400.

As described above, because the leakage inductor Lr1 is formed at a portion that the lower secondary winding 1311, 1312 or the upper secondary winding 1313, 1314 is not interlinked with the primary winding 1211, the planar transformer according to the first embodiment of the present invention does not need to use a separate core having a small magnetic permeability or to provide a separate leakage inductor at the outside thereof.

Moreover, since it is possible to adjust a surface area of the portion that the lower secondary winding 1311, 1312 or the upper secondary winding 1313, 1314 is not interlinked with the primary winding 1211 and thus control a leakage inductance of the leakage inductor Lr1, the planar transformer according to the first embodiment of the present invention can secure a sufficient leakage inductance therein.

More detailedly, it is possible to adjust an inductance of the leakage inductor Lr1 by controlling a length of the second front sill 1121, the first right sill 1122 or the second rear sill 1123 of the first planar core 1100.

Meanwhile, it is also possible to efficiently discharge heat generated in the planar transformer by controlling a length Icw1 between the first front sill 1131 of the first 10 planar core 1100 and the second front sill 1121 of the first planar core 1100 or a length between the first rear sill 1133 of the first planar core 1100 and the second rear sill 1123 of the first planar core 1100.

Accordingly, by controlling the length Icw1 between the first front sill 1131 of the first planar core 1100 and the second front sill 1121 of the first planar core 1100 to be the same as the length between the first rear sill 1133 of the first planar core 1100 and the second rear sill 1123 of the first planar core 1100, it is possible to efficiently discharge the heat generated in the planar transformer.

Furthermore, by controlling a length between the third front sill 1431 of the second planar core 1400 and the fourth front sill 1421 of the second planar core 1400 to be the same as the length between the third rear sill 1433 of the second planar core 1400 and the fourth rear sill 1423 of the second planar core 1400, it is possible to further efficiently discharge the heat generated in the planar transformer.

The first and second planar cores 1100 and 1400 may be disposed so that the first front sill 1131 of the first planar core 1100 and the third front sill 1431 of the second planar core 1400 are spaced apart from each other at a desired distance. A leakage inductance of the transformer TR1 can be controlled by adjusting the distance ITg1 between the first front sill 1131 of the first planar core 1100 and the third front sill 1431 of the second planar core 1400.

Further, the first and second planar cores 1100 and 1400 may be disposed so that the first rear sill 1133 of the first planar core 1100 and the third rear sill 1433 of the second planar core 1400 are spaced apart from each other at a desired distance. The leakage inductance of the transformer TR1 can be controlled by adjusting the distance between the first rear sill 1133 of the first planar core 1100 and the third rear sill 1433 of the second planar core 1400.

Herein, the first and second planar cores 1100 and 1400 may be disposed so that the second front sill 1121 of the first planar core 1100 and the fourth front sill 1421 of the second planar core 1400 are spaced apart from each other at a desired distance. A leakage inductance of the leakage inductor Lr1 can be controlled by adjusting the distance ILg1 between the second front sill 1121 of the first planar core 1100 and the fourth front sill 1421 of the second planar core 1400.

Further, the first and second planar cores 1100 and 1400 may be disposed so that the second rear sill 1123 of the first planar core 1100 and the fourth rear sill 1423 of the second planar core 1400 are spaced apart from each other at a desired distance. The leakage inductance of the leakage inductor Lr1 can be controlled by adjusting the distance between the second rear sill 1123 of the first planar core 1100 and the fourth rear sill 1423 of the second planar core 1400.

The first left sill 1132 or the first right sill 1122 of the first planar core 1100, or the 11 second left sill 1432 or the second right sill 1422 of the second planar core 1400 may be formed into a rectangular shape as shown in FIG. 1.

Figure 5:
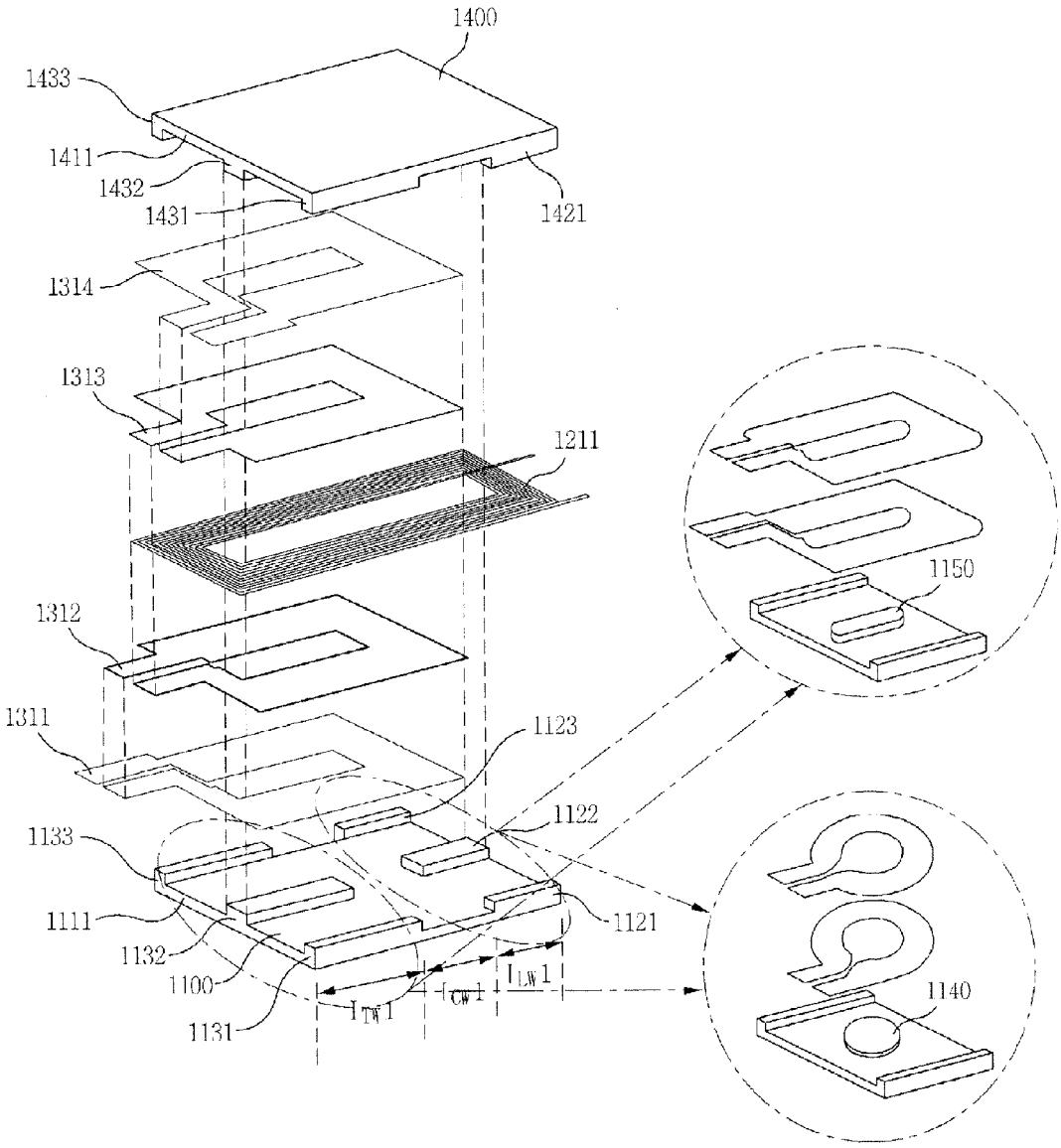
FIG. 5 is an exploded perspective view showing a modified embodiment of the planar transformer according to the first and second embodiments of the present invention.

Meanwhile, as shown in FIG. 5, the first left sill 1132 or the first right sill 1122 of the first planar core 1100 may be formed into an elliptical shape 1150 or a circular shape 1140. The lower secondary winding 1311, 1312, the upper secondary winding 1313, 1314 or the primary winding 1211 may be changed into various shapes according to the shape of the first left sill 1132 or the first right sill 1122.

The second left sill 1432 or the second right sill 1422 of the second planar core 1400 may be also formed into an elliptical or circular shape.

Figure 3:
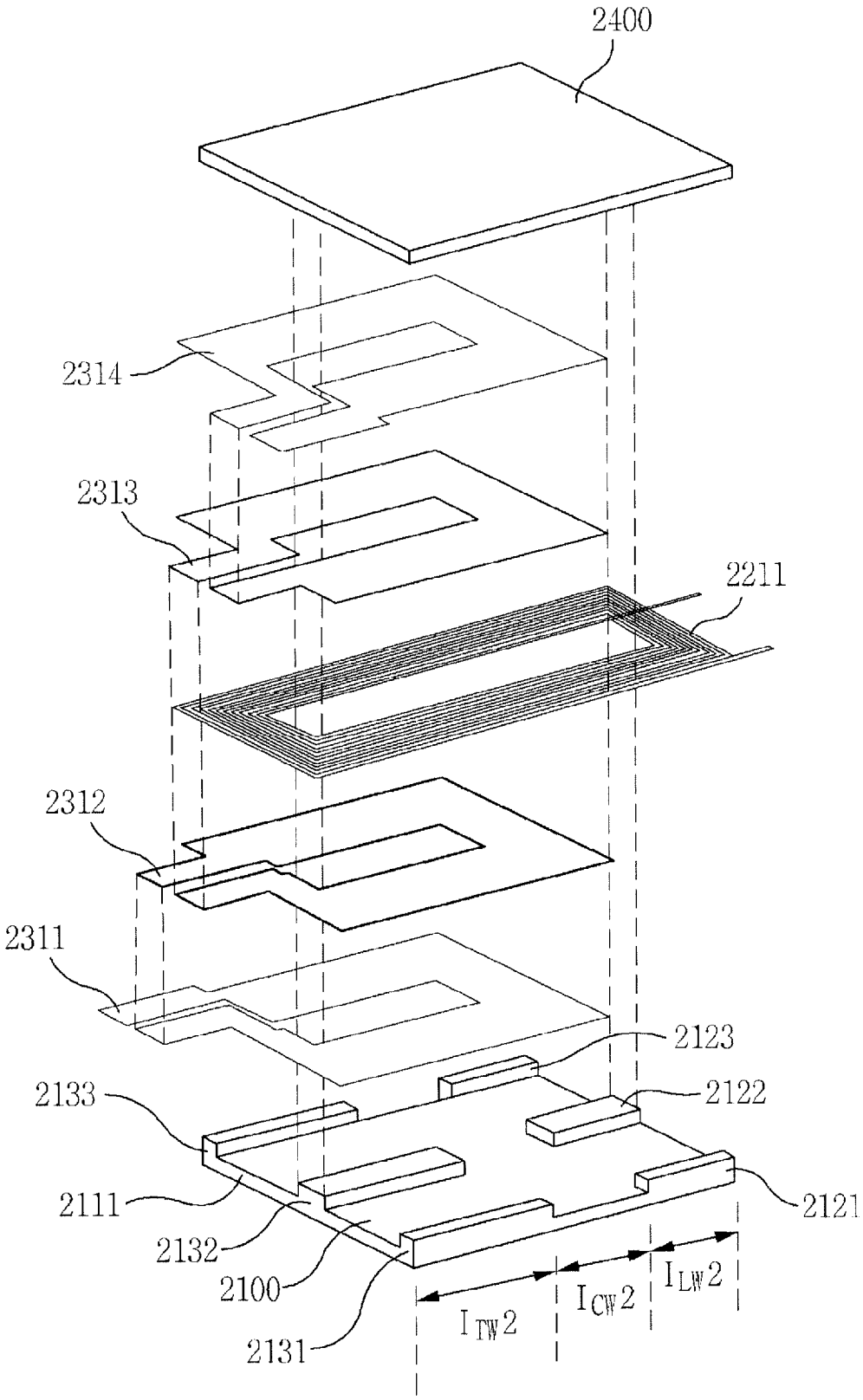
FIG. 3 is an exploded perspective view of a planar transformer according to a second embodiment of the present invention.
Figure 4:
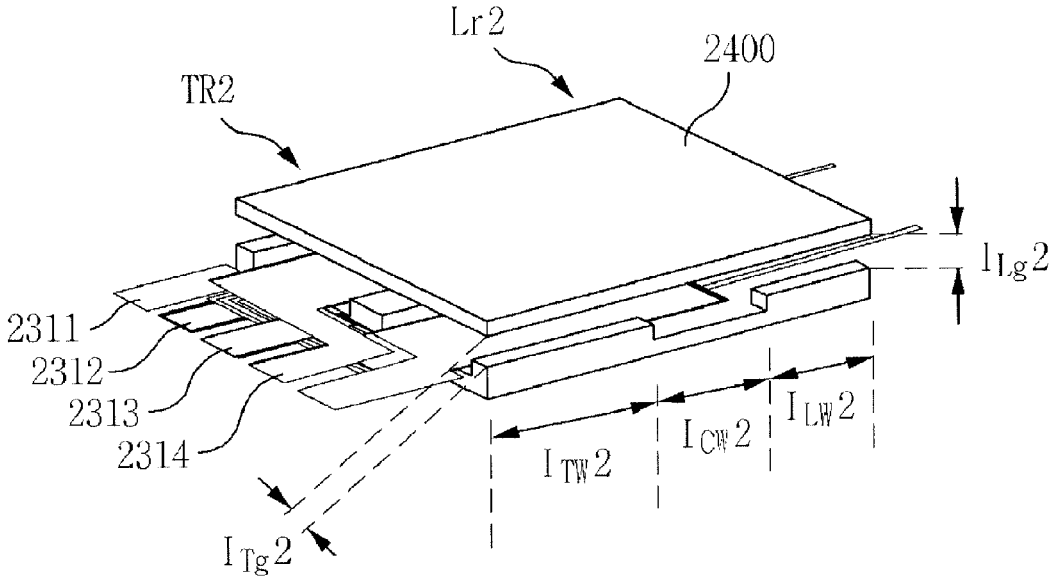
FIG. 4 is a perspective view of the planar transformer according to the second embodiment of the present invention.

Hereinafter, a planar transformer according to a second embodiment of the present invention will be described with reference to FIGS. 3 and 4. FIG. 3 is an exploded perspective view of a planar transformer according to a second embodiment of the present invention, and FIG. 4 is a perspective view of the planar transformer according to the second embodiment of the present invention. Herein, only the difference from the planar transformer according to the first embodiment of the present invention will be described.

A second planar core 2400 is formed of a rectangular magnetic substance and disposed on an upper secondary winding 2313, 2314 and a primary winding 2211. Meanwhile, the second planar core 2400 may be also formed of various-shaped magnetic substances such as a rectangular magnetic substance, a square magnetic substance, an elliptical magnetic substance and a circular magnetic substance according to electronic products in which the second planar core 2400 is used.

Figure 6:
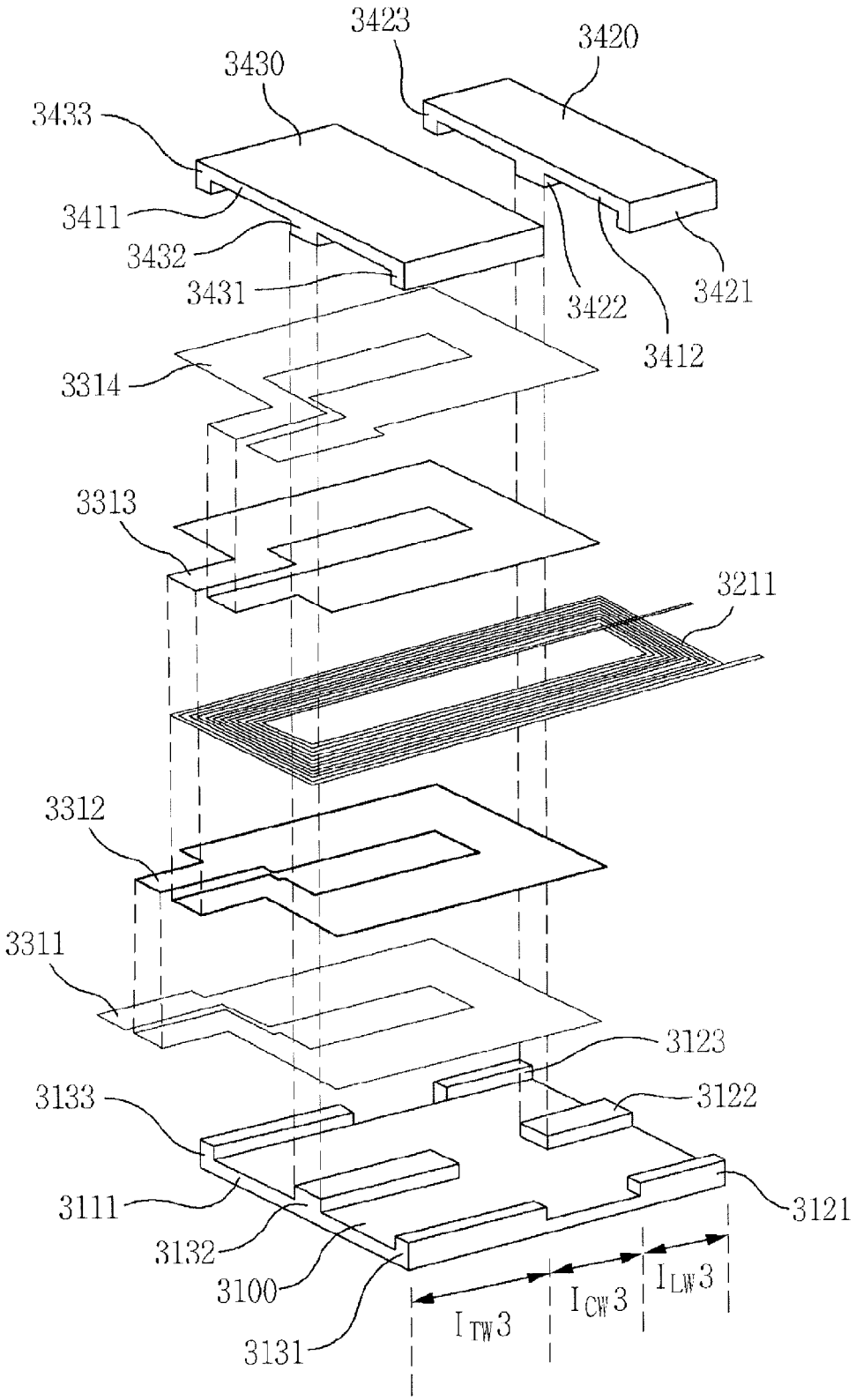
FIG. 6 is an exploded perspective view of a planar transformer according to a third embodiment of the present invention.
Figure 7:
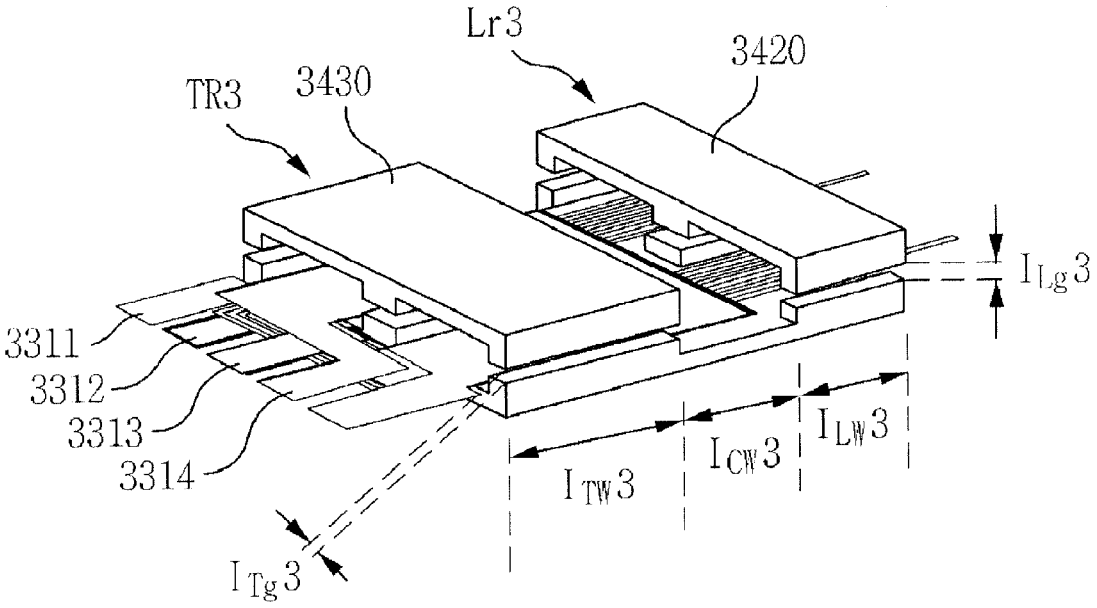
FIG. 7 is a perspective view of the planar transformer according to the third embodiment of the present invention.

Hereinafter, a planar transformer according to a third embodiment of the present invention will be described with reference to FIGS. 6 and 7. FIG. 6 is an exploded perspective view of a planar transformer according to a third embodiment of the present invention, and FIG. 7 is a perspective view of the planar transformer according to the third embodiment of the present invention.

As shown in FIG. 6, a first planar core 3100 includes a first main body 3111 which is formed of a rectangular magnetic substance, a first rear sill 3133 which is formed to be extended at a left rear long side of the first main body 3111, a second rear sill 3123 which is formed to be extended at a right rear long side of the first main body 3111, a first front sill 3131 which is formed to be extended at a left front long side of the first main body 3111, a second front sill 3121 which is formed to be extended at a right front long side of the first main body 3111, a first left sill 3132 which is formed at a center portion between the first rear sill 3133 and the first front sill 3131 so as to have a desired length, and a first right sill 3122 which is formed at a center portion between the second rear sill 3123 and the second front sill 3121 so as to have a desired length and also which is spaced apart from the first left sill 3132. In the first planar core 3100, the first rear sill 3133, the second rear sill 3123, the first front sill 3131, the second front sill 3121, the first left sill 3132 and the first right sill 3122 may be integrally formed with the first main body 1111.

Meanwhile, the first main body 3111 may be formed of various-shaped magnetic substances such as a rectangular magnetic substance, a square magnetic substance, an elliptical magnetic substance and a circular magnetic substance according to electronic products in which the first main body 3111 is used.

A lower secondary winding 3311, 3312 formed by stacking a plurality of coils is disposed to enclose the first left sill 3132 of the first planar core 3100 between the first rear sill 3133 and the first front sill 3131 of the first planar core 3100.

A primary winding 3211 formed into a rectangular shape having a plurality of wound coils is disposed on the lower secondary winding 3311, 3312 so as to enclose the first left and right sills 3132 and 3122 of the first planar core 3100.

An upper secondary winding 3313, 3314 formed by stacking a plurality of coils is disposed on the primary winding 3211 to enclose the first left sill 3132 of the first planar core 3100.

A second left planar core 3430 is disposed on the upper secondary winding 3313, 3314. The second left planar core 3430 includes a twenty-first main body 3411 which is formed of a rectangular magnetic substance, a third rear sill 3433 which is formed to be extended at a rear long side of the twenty-first main body 3411 and also to be opposed to the first rear sill 3133 of the first planar core 3100, a third front sill 3431 which is formed to be extended at a front long side of the twenty-first main body 3411 and also to be opposed to the first front sill 3131 of the first planar core 3100, and a second left sill 3432 which is formed at a center portion between the third rear sill 3433 and the third front sill 3431 so as to have a desired length and also opposed to the first left sill 3132 of the first planar core 3100. In the second left planar core 3430, the third rear sill 3433, the third front sill 3431, and the second left sill 3432 may be integrally formed with the twenty-first main body 3411. Meanwhile, the twenty-first main body 3411 may be formed of various-shaped magnetic substances such as a rectangular magnetic substance, a square magnetic substance, an elliptical magnetic substance and a circular magnetic substance according to electronic products in which the twenty-first main body 3411 is used.

A second right planar core 3420 is disposed on the primary winding 3211 so as to be spaced apart from the second left planar core 3430. The second right planar core 3420 includes a twenty-second main body 3412 which is formed of a rectangular magnetic substance, a fourth rear sill 3423 which is formed to be extended at a rear long side of the twenty-second main body 3412 and also to be opposed to the second rear sill 3123 of the first planar core 3100, a fourth front sill 3421 which is formed to be extended at a front long side of the twenty-second main body 3412 and also to be opposed to the second front sill 3121 of the first planar core 3100, and a second right sill 3422 which is formed at a center portion between the fourth rear sill 3423 and the fourth front sill 3421 so as to have a desired length and also opposed to the first right sill 3122 of the first planar core 3100. In the second right planar core 3420, the fourth rear sill 3423, the fourth front sill 3421, and the second right sill 3422 may be integrally formed with the twenty-second main body 3412. Meanwhile, the twenty-second main body 3412 may be formed of various-shaped magnetic substances such as a rectangular magnetic substance, a square magnetic substance, an elliptical magnetic substance and a circular magnetic substance according to electronic products in which the twenty-second main body 3412 is used.

In the planar transformer according to the third embodiment of the present invention, as shown in FIG. 7, a transformer TR3 is formed at an overlapped portion of the first planar core 3100, the lower secondary winding 3311, 3312, the primary winding 3211, the upper second winding 3313, 3314 and the second left planar core 3430, and a leakage inductor Lr3 is formed at an overlapped portion of the first planar core 3100, the primary winding 3211 and the second right planar core 3420.

On the other hand, it is necessary to insulate between the first planar core 3100 and the lower secondary winding 3311, 3312, between the lower secondary winding 3311, 3312 and the primary winding 3211, between the primary winding 3211 and the upper secondary winding 3313, 3314, between the upper secondary winding 3313, 3314 and the second left planar core 3430, and between the primary winding 3211 and the second right planar core 3420.

As described above, because the leakage inductor Lr3 is formed at a portion that the lower secondary winding 3311, 3312 or the upper secondary winding 3313, 3314 is not interlinked with the primary winding 3211, the planar transformer according to the third embodiment of the present invention does not need to use a separate core having a small magnetic permeability or to provide a separate leakage inductor at the outside thereof.

Moreover, since it is possible to adjust a surface area of the portion that the lower secondary winding 3311, 3312 or the upper secondary winding 3313, 3314 is not interlinked with the primary winding 3211 and thus control a leakage inductance of the leakage inductor Lr3, the planar transformer according to the third embodiment of the present invention can secure a sufficient leakage inductance therein.

More detailedly, it is possible to adjust an inductance of the leakage inductor Lr3 by controlling a length of the second front sill 3121, the first right sill 3122 or the second rear sill 3123 of the first planar core 3100.

Meanwhile, it is also possible to efficiently discharge heat generated in the planar transformer by controlling a length lcw3 between the first front sill 3131 of the first planar core 3100 and the second front sill 3121 of the first planar core 3100 or a length between the first rear sill 3133 of the first planar core 3100 and the second rear sill 3123 of the first planar core 3100.

Accordingly, by controlling the length lcw3 between the first front sill 3131 of the first planar core 3100 and the second front sill 3121 of the first planar core 3100 to be the same as the length between the first rear sill 3133 of the first planar core 3100 and the second rear sill 3123 of the first planar core 3100, it is possible to efficiently discharge the heat generated in the planar transformer.

The first planar core 3100 and the second left planar core 3430 may be disposed so that the first front sill 3131 of the first planar core 3100 and the third front sill 3431 of the second left planar core 3430 are spaced apart from each other at a desired distance. A leakage inductance of the transformer TR1 can be controlled by adjusting the distance lTg3 between the first front sill 3131 of the first planar core 3100 and the third front sill 3431 of the second left planar core 3430.

Further, the first planar core 3100 and the second left planar core 3430 may be disposed so that the first rear sill 3133 of the first planar core 3100 and the third rear sill 3433 of the second left planar core 3430 are spaced apart from each other at a desired distance. The leakage inductance of the transformer TR3 can be controlled by adjusting the distance between the first rear sill 3133 of the first planar core 3100 and the third rear sill 3433 of the second left planar core 3430.

Herein, the first planar core 3100 and the second right planar core 3420 may be disposed so that the second front sill 3121 of the first planar core 3100 and the fourth front sill 3421 of the second right planar core 3420 are spaced apart from each other at a desired distance. A leakage inductance of the leakage inductor Lr3 can be controlled by adjusting the distance lLg3 between the second front sill 3121 of the first planar core 3100 and the fourth front sill 3421 of the second right planar core 3420.

Further, the first planar core 3100 and the second right planar core 3420 may be disposed so that the second rear sill 3123 of the first planar core 3100 and the fourth rear sill 3420 of the second right planar core 3420 are spaced apart from each other at a desired distance. A leakage inductance of the leakage inductor Lr3 can be controlled by adjusting the distance between the second rear sill 3123 of the first planar core 3100 and the fourth rear sill 3423 of the second right planar core 3420.

The first left sill 3132 or the first right sill 3122 of the first planar core 3100, or the second left sill 3432 of the second left planar core 3430 or the second right sill 3422 of the second right planar core 3420 may be formed into a rectangular shape as shown in FIG. 6.

Figure 10:
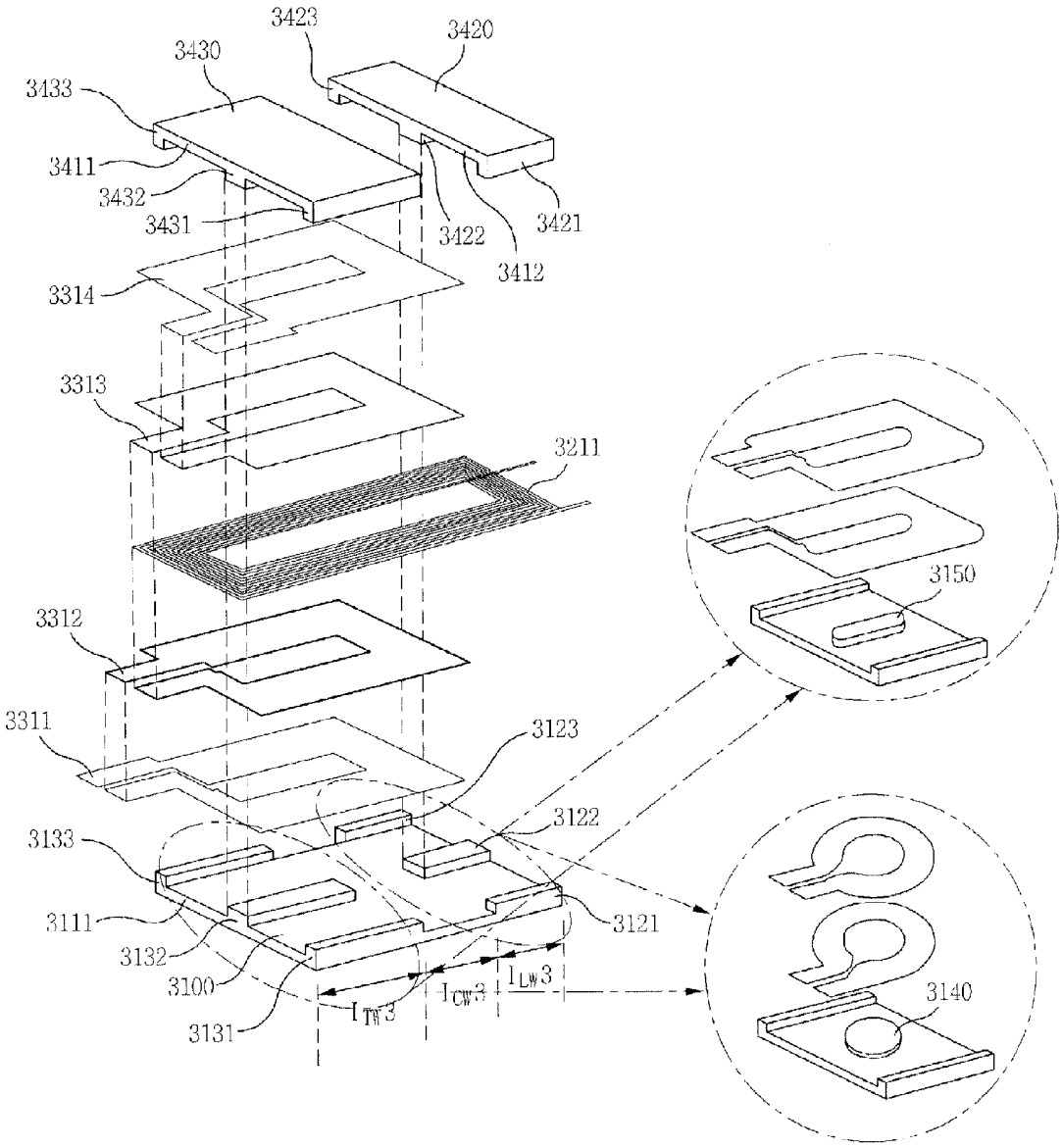
FIG. 10 is an exploded perspective view showing a modified embodiment of the planar transformer according to the third and fourth embodiments of the present invention.

Meanwhile, as shown in FIG. 10, the first left sill 3132 or the first right sill 3122 of the first planar core 3100 may be formed into an elliptical shape 3150 or a circular shape 3140.

The lower secondary winding 3311, 3312, the upper secondary winding 3313, 3314 or the primary winding 3211 may be changed into various shapes according to the shape of the first left sill 3132 or the first right sill 3122.

The second left sill 3432 of the second left planar core 3430 or the second right sill 3422 of the second right planar core 3420 may be also formed into an elliptical or circular shape.

Figure 8:
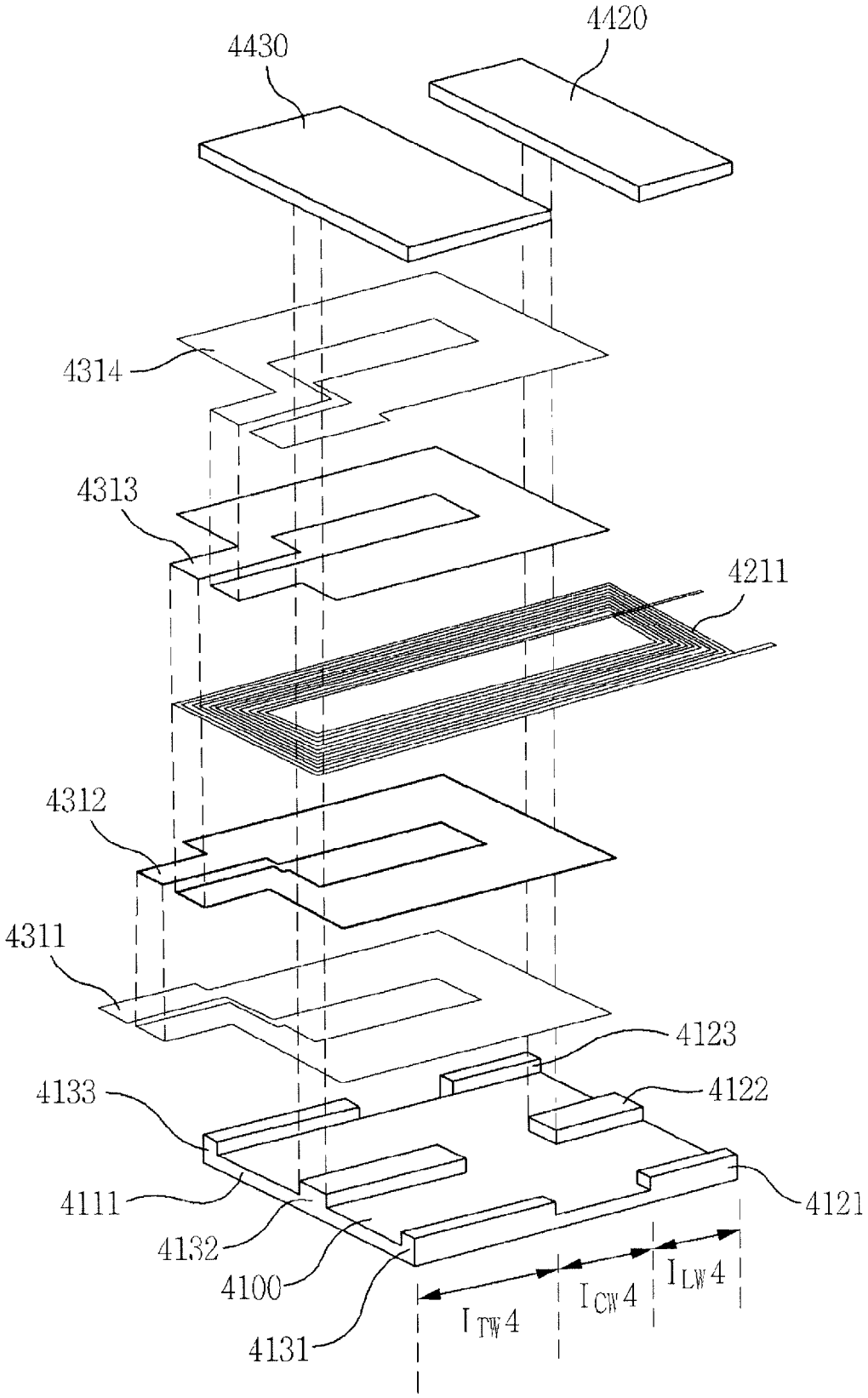
FIG. 8 is an exploded perspective view of a planar transformer according to a fourth embodiment of the present invention.
Figure 9:
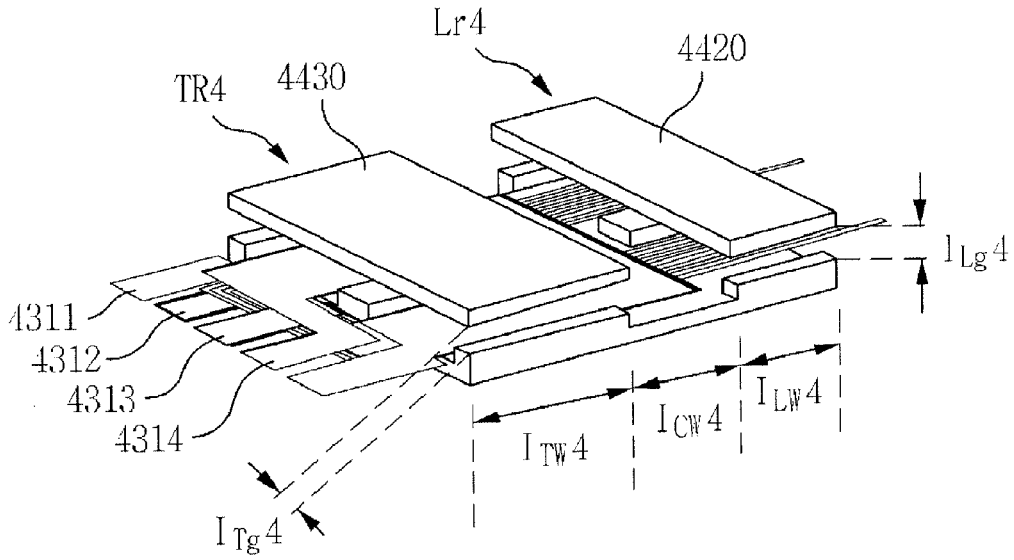
FIG. 9 is a perspective view of the planar transformer according to the fourth embodiment of the present invention.

Hereinafter, a planar transformer according to a fourth embodiment of the present invention will be described with reference to FIGS. 8 and 9. FIG. 8 is an exploded perspective view of a planar transformer according to a fourth embodiment of the present invention, and FIG. 9 is a perspective view of the planar transformer according to the fourth embodiment of the present invention. Herein, only the difference from the planar transformer according to the third embodiment of the present invention will be described.

As shown in FIG. 8, a second left planar core 4430 is formed of a rectangular magnetic substance and disposed on an upper secondary winding 4313, 4314 so as to be opposed to a first rear sill 4133, a first front sill 4131 and a first left sill 4132 of a first planar core 4100. The second left planar core 4430 may be also formed of various shaped magnetic substances such as a rectangular magnetic substance, a square magnetic substance, an elliptical magnetic substance and a circular magnetic substance according to electronic products in which the second left planar core 4430 is used.

Meanwhile, a second right planar core 4420 is formed of a rectangular magnetic substance and disposed on a primary winding 4211 so as to be spaced apart from the second left planar core 4430 and also to be opposed to a second rear sill 4123, a second front sill 4121 and a right sill 4122 of a first planar core 4100. The second right planar core 4420 may be also formed of various-shaped magnetic substances such as a rectangular magnetic substance, a square magnetic substance, an elliptical magnetic substance and a circular magnetic substance according to electronic products in which the second right planar core 4420 is used.

Figure 11:
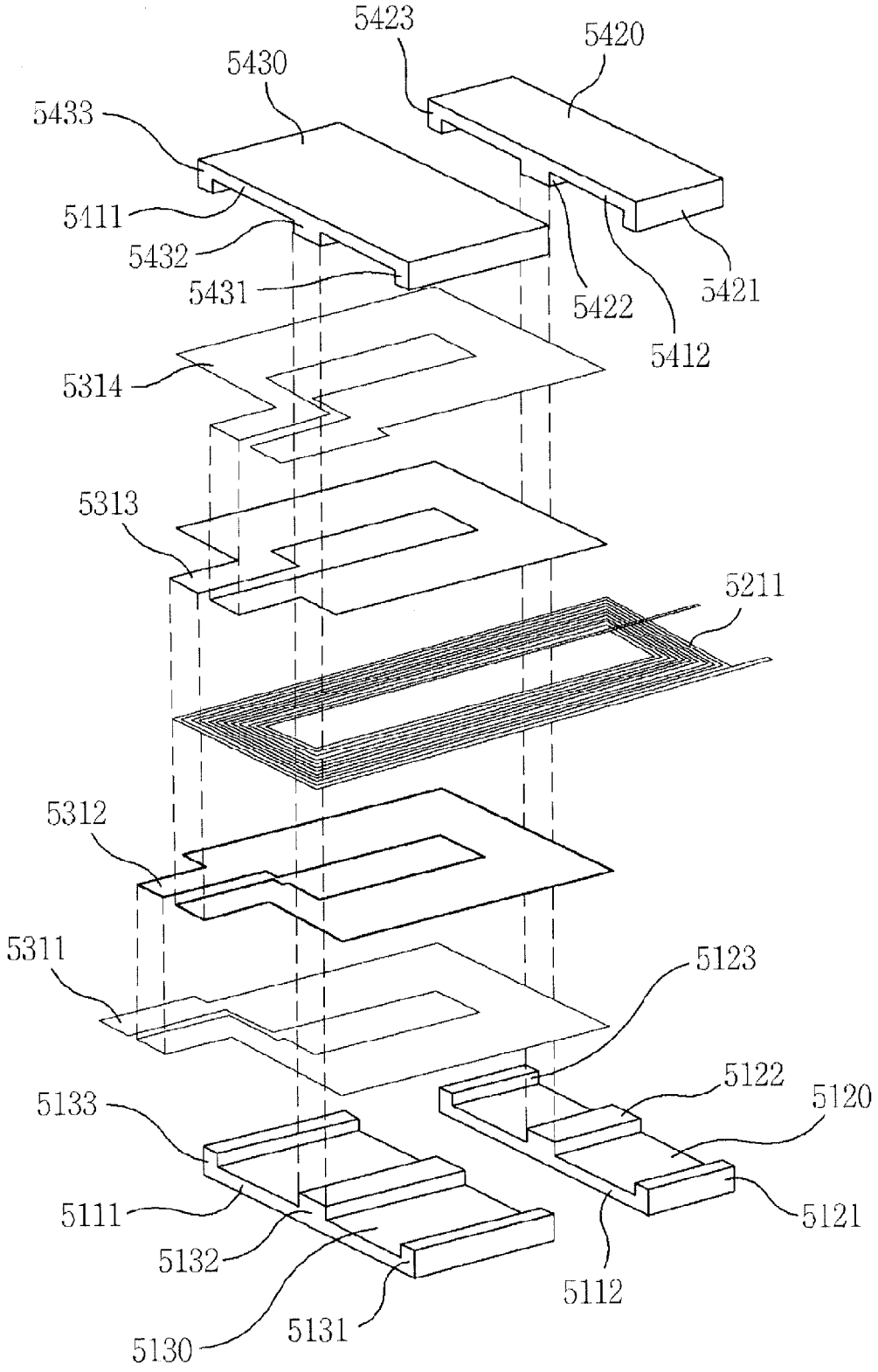
FIG. 11 is an exploded perspective view of a planar transformer according to a fifth embodiment of the present invention.
Figure 12:
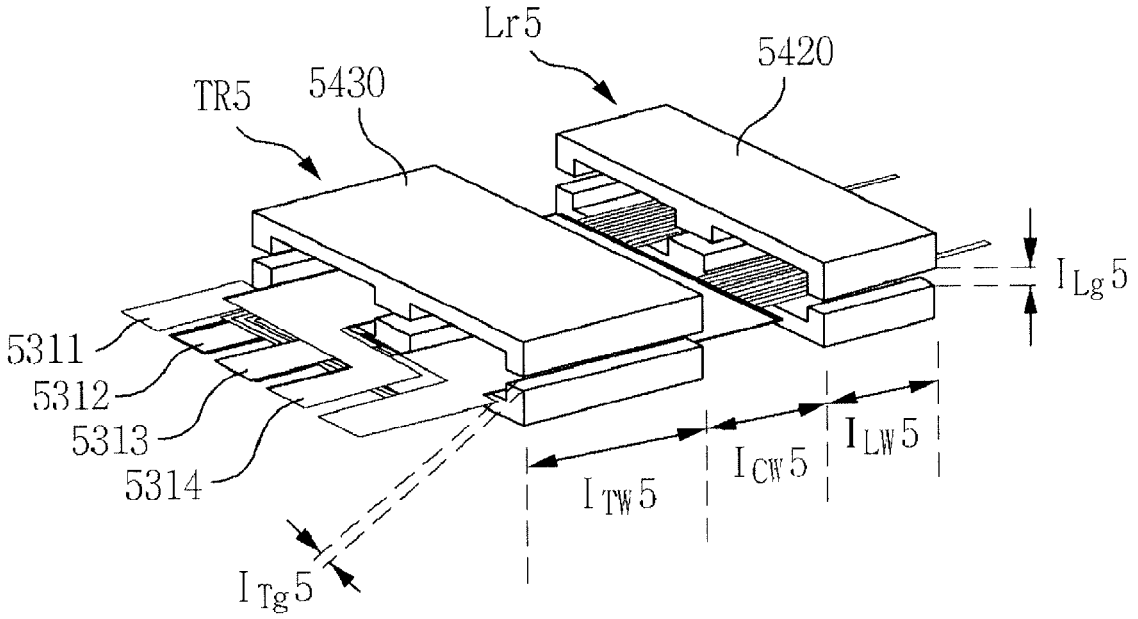
FIG. 12 is a perspective view of the planar transformer according to the fifth embodiment of the present invention.

Hereinafter, a planar transformer according to a fifth embodiment of the present invention will be described with reference to FIGS. 11 and 12. FIG. 11 is an exploded perspective view of a planar transformer according to a fifth embodiment of the present invention, and FIG. 12 is a perspective view of the planar transformer according to the fifth embodiment of the present invention.

As shown in FIG. 11, a first left planar core 5130 includes an eleventh main body 5111 which is formed of a rectangular magnetic substance, a first rear sill 5133 which is formed to be extended at a rear long side of the eleventh main body 5111, a first front sill 5131 which is formed to be extended at a front long side of the eleventh main body 5111, and a first left sill 5132 which is formed at a center portion between the first rear sill 5133 and the first front sill 5131 so as to have a desired length. In the first left planar core 5100, the first rear sill 5133, the first front sill 5131 and the first left sill 5132 may be integrally formed with the eleventh main body 5111. Meanwhile, the eleventh main body 5111 may be formed of various-shaped magnetic substances such as a rectangular magnetic substance, a square magnetic substance, an elliptical magnetic substance and a circular magnetic substance according to electronic products in which the eleventh main body 5111 is used.

As shown in FIG. 11, a first right planar core 5120 includes a twelfth main body 5112 which is formed of a rectangular magnetic substance so as to be spaced apart from the first left planar core 5130, a second rear sill 5123 which is formed to be extended at a rear long side of the twelfth main body 5112, a second front sill 5121 which is formed to be extended at a front long side of the twelfth main body 5112, and a first right sill 5132 which is formed at a center portion between the second rear sill 5123 and the second front sill 5121 so as to have a desired length. In the first right planar core 5120, the second rear sill 5123, the second front sill 5121 and the first right sill 5122 may be integrally formed with the twelfth main body 5112. Meanwhile, the twelfth main body 5112 may be formed of various-shaped magnetic substances such as a rectangular magnetic substance, a square magnetic substance, an elliptical magnetic substance and a circular magnetic substance according to electronic products in which the twelfth main body 5112 is used.

A lower secondary winding 5311, 5312 formed by stacking a plurality of coils is disposed to enclose the first left sill 5132 of the first left planar core 5130 between the first rear sill 5133 and the first front sill 5131 of the first left planar core 5130.

A primary winding 5211 formed into a rectangular shape having a plurality of wound coils is disposed on the lower secondary winding 5311, 5312 so as to enclose the first left sill 5132 of the first left planar core 5130 and the first right sills 5122 of the first right planar core 5120.

An upper secondary winding 5313, 5314 formed by stacking a plurality of coils is disposed on the primary winding 5211 to enclose the first left sill 5132 of the first left planar core 5130.

A second left planar core 5430 is disposed on the upper secondary winding 5313, 5314. The second left planar core 5430 includes a twenty-first main body 5411 which is formed of a rectangular magnetic substance, a third rear sill 5123 which is formed to be extended at a rear long side of the twenty-first main body 5411 and also to be opposed to the first rear sill 5133 of the first left planar core 5130, a third front sill 5121 which is formed to be extended at a front long side of the twenty-first main body 5411 and also to be opposed to the first front sill 5131 of the first left planar core 5130, and a second left sill 5122 which is formed at a center portion between the third rear sill 5123 and the third front sill 5121 so as to have a desired length and also opposed to the first left sill 5132 of the first planar core 5130. In the second left planar core 5430, the third rear sill 5123, the third front sill 5121, and the second left sill 5122 may be integrally formed with the twenty-first main body 5411. Meanwhile, the twenty-first main body 5411 may be formed of various-shaped magnetic substances such as a rectangular magnetic substance, a square magnetic substance, an elliptical magnetic substance and a circular magnetic substance according to electronic products in which the twenty-first main body 5411 is used.

A second right planar core 5420 is disposed on the primary winding 5211 so as to be spaced apart from the second left planar core 5430. The second right planar core 5420 includes a twenty-second main body 5412 which is formed of a rectangular magnetic substance, a fourth rear sill 5423 which is formed to be extended at a rear long side of the twenty-second main body 5412 and also to be opposed to the second rear sill 5123 of the first right planar core 5430, a fourth front sill 5421 which is formed to be extended at a front long side of the twenty-second main body 5412 and also to be opposed to the second front sill 5121 of the first right planar core 5120, and a second right sill 5422 which is formed at a center portion between the fourth rear sill 5423 and the fourth front sill 5421 so as to have a desired length and also opposed to the first right sill 5122 of the first right planar core 5120. In the second right planar core 5420, the fourth rear sill 5423, the fourth front sill 5421, and the second right sill 5422 may be integrally formed with the twenty-second main body 5412. Meanwhile, the twenty second main body 5412 may be formed of various-shaped magnetic substances such as a rectangular magnetic substance, a square magnetic substance, an elliptical magnetic substance and a circular magnetic substance according to electronic products in which the twenty-second main body 5412 is used.

In the planar transformer according to the fifth embodiment of the present invention, as shown in FIG. 12, a transformer TR5 is formed at an overlapped portion of the first left planar core 5130, the lower secondary winding 5311, 5312, the primary winding 5211, the upper second winding 5313, 5314 and the second left planar core 5430, and a leakage inductor Lr5 is formed at an overlapped portion of the first right planar core 5120, the primary winding 5211 and the second right planar core 5420.

On the other hand, it is necessary to insulate between the first left planar core 5130 and the lower secondary winding 5311, 5312, between the lower secondary winding 5311, 5312 and the primary winding 5211, between the primary winding 5211 and the upper secondary winding 5313, 5314, between the upper secondary winding 5313, 5314 and the second left planar core 5430, and between the primary winding 5211 and the second right planar core 5420.

As described above, because the leakage inductor Lr5 is formed at a portion that the lower secondary winding 5311, 5312 or the upper secondary winding 5313, 5314 is not interlinked with the primary winding 5211, the planar transformer according to the fifth embodiment of the present invention does not need to use a separate core having a small magnetic permeability or to provide a separate leakage inductor at the outside thereof.

Moreover, since it is possible to adjust a surface area of the portion that the lower secondary winding 5311, 5312 or the upper secondary winding 5313, 5314 is not interlinked with the primary winding 5211 and thus control a leakage inductance of the leakage inductor Lr5, the planar transformer according to the fifth embodiment of the present invention can secure a sufficient leakage inductance therein.

Meanwhile, the first left planar core 5130 and the second left planar core 5430 may be disposed so that the first front sill 5131 of the first left planar core 5130 and the third front sill 51211 of the second left planar core 5430 are spaced apart from each other at a desired distance. A leakage inductance of the transformer TR5 can be controlled by adjusting the distance ITg5 between the first front sill 5131 of the first left planar core 5130 and the third front sill 5121 of the second left planar core 5430.

Further, the first left planar core 5130 and the second left planar core 5430 may be disposed so that the first rear sill 5133 of the first left planar core 5130 and the third rear sill 5123 of the second left planar core 5430 are spaced apart from each other at a desired distance. The leakage inductance of the transformer TR5 can be controlled by adjusting the distance between the first rear sill 5133 of the first left planar core 5130 and the third rear sill 5123 of the second left planar core 5430.

Herein, the first right planar core 5120 and the second right planar core 5420 may be disposed so that the second front sill 5121 of the first right planar core 5120 and the fourth front sill 5421 of the second right planar core 5420 are spaced apart from each other at a desired distance. A leakage inductance of the leakage inductor Lr5 can be controlled by adjusting the distance ILg5 between the second front sill 5121 of the first right planar core 5120 and the fourth front sill 5421 of the second right planar core 5420.

Further, the first right planar core 5120 and the second right planar core 5420 may be disposed so that the second rear sill 5123 of the first right planar core 5120 and the fourth rear sill 5420 of the second right planar core 5420 are spaced apart from each other at a desired distance. A leakage inductance of the leakage inductor Lr5 can be controlled by adjusting the distance between the second rear sill 5123 of the first right planar core 5120 and the fourth rear sill 5423 of the second right planar core 5420.

The first left sill 5132 of the first left planar core 5130 or the first right sill 5122 of the first right planar core 5120, or the second left sill 5122 of the second left planar core 5430 or the second right sill 5422 of the second right planar core 5420 may be formed into a rectangular shape as shown in FIG. 11.

Figure 15:
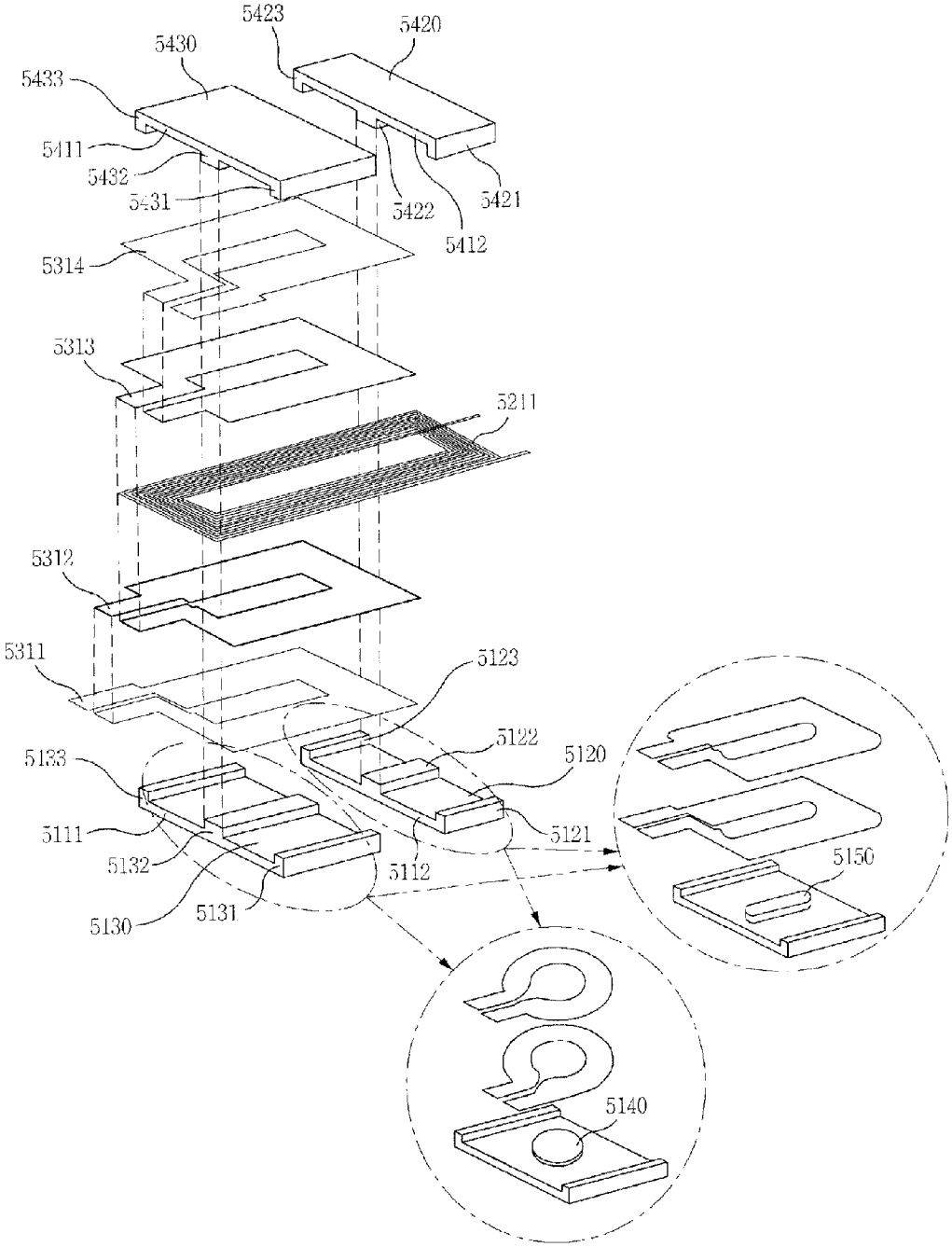
FIG. 15 is an exploded perspective view showing a modified embodiment of the planar transformer according to the fifth and sixth embodiments of the present invention.

Meanwhile, as shown in FIG. 15, the first left sill 5132 of the first left planar core 5130 or the first right sill 5122 of the first right planar core 5120 may be formed into an elliptical shape 5150 or a circular shape 5140. The lower secondary winding 5311, 5312, the upper secondary winding 5313, 5314 or the primary winding 5211 may be changed into various shapes according to the shape of the first left sill 5132 or the first right sill 5122.

The second left sill 5122 of the second left planar core 5430 or the second right sill 5422 of the second right planar core 5420 may be also formed into an elliptical or circular shape.

Hereinafter, a planar transformer according to a sixth embodiment of the present invention will be described with reference to FIGS. 13 and 14.

Figure 13:
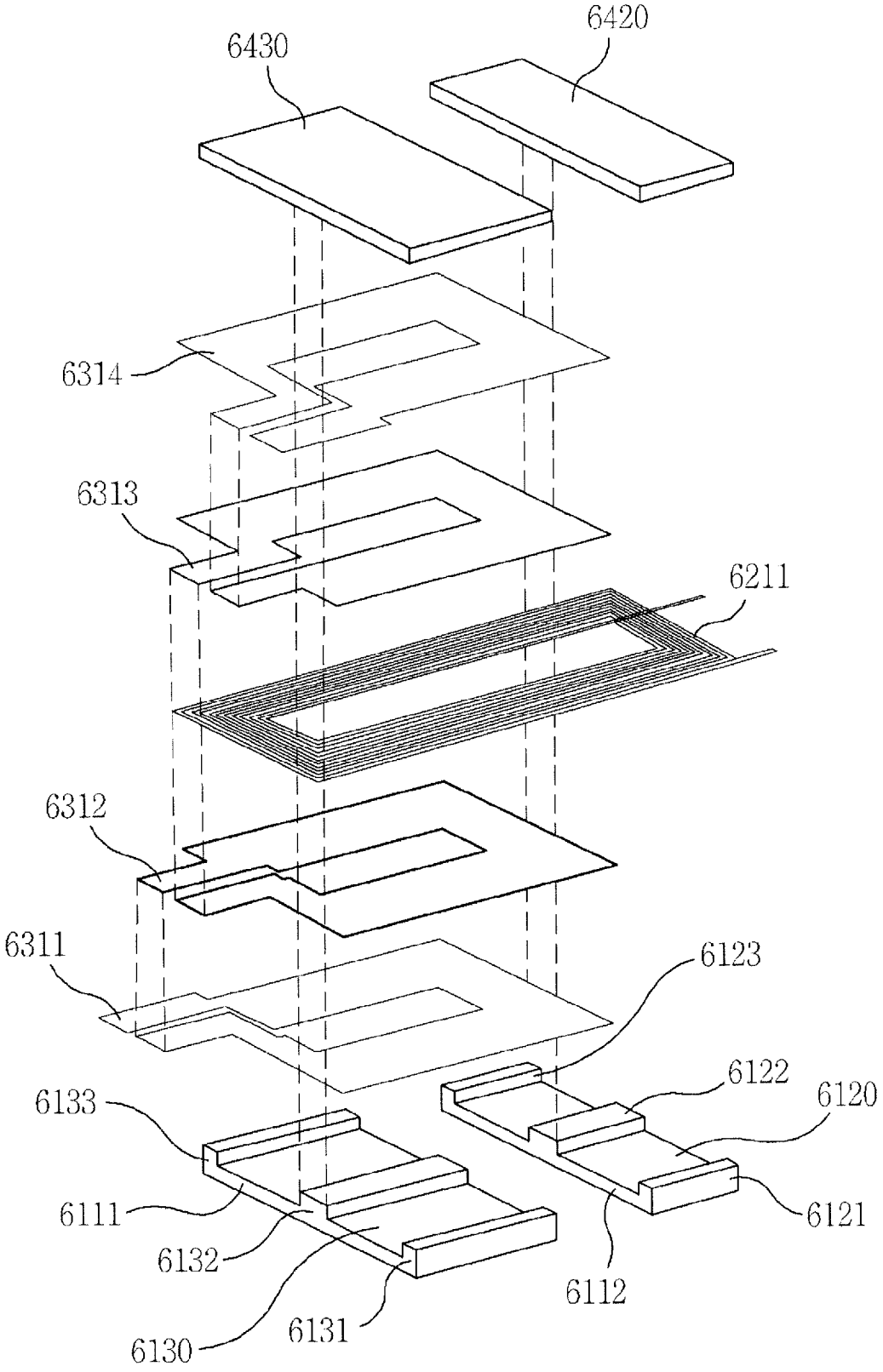
FIG. 13 is an exploded perspective view of a planar transformer according to a sixth embodiment of the present invention.
Figure 14:
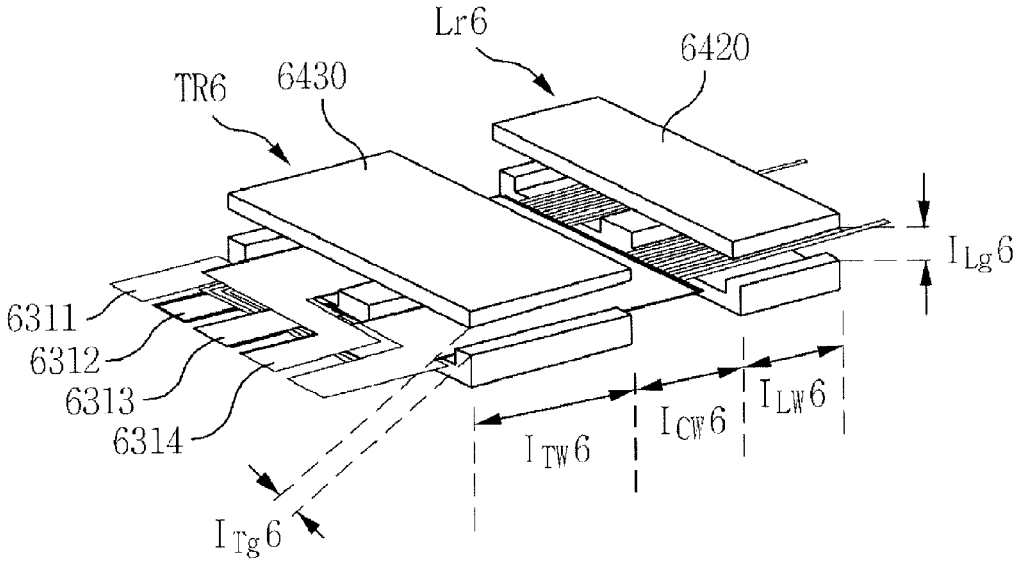
FIG. 14 is a perspective view of the planar transformer according to the sixth embodiment of the present invention.

FIG. 13 is an exploded perspective view of a planar transformer according to a sixth embodiment of the present invention, and FIG. 14 is a perspective view of the planar transformer according to the sixth embodiment of the present invention. Herein, only the difference from the planar transformer according to the fifth embodiment of the present invention will be described.

As shown in FIG. 13, a second left planar core 6430 is formed of a rectangular magnetic substance and disposed on an upper secondary winding 6313, 6314 so as to be opposed to a first rear sill 6133, a first front sill 6131 and a first left sill 6132 of a first left planar core 6130. The second left planar core 6430 may be also formed of various-shaped magnetic substances such as a rectangular magnetic substance, a square magnetic substance, an elliptical magnetic substance and a circular magnetic substance according to electronic products in which the second left planar core 6430 is used.

Meanwhile, a second right planar core 6420 is formed of a rectangular magnetic substance and disposed on a primary winding 6211 so as to be spaced apart from the second left planar core 6430 and also to be opposed to a second rear sill 6123, a second front sill 6121 and a right sill 6122 of a first right planar core 6120. The second right planar core 6420 may be also formed of various-shaped magnetic substances such as a rectangular magnetic substance, a square magnetic substance, an elliptical magnetic substance and a circular magnetic substance according to electronic products in which the second right planar core 6420 is used.

Figure 16:
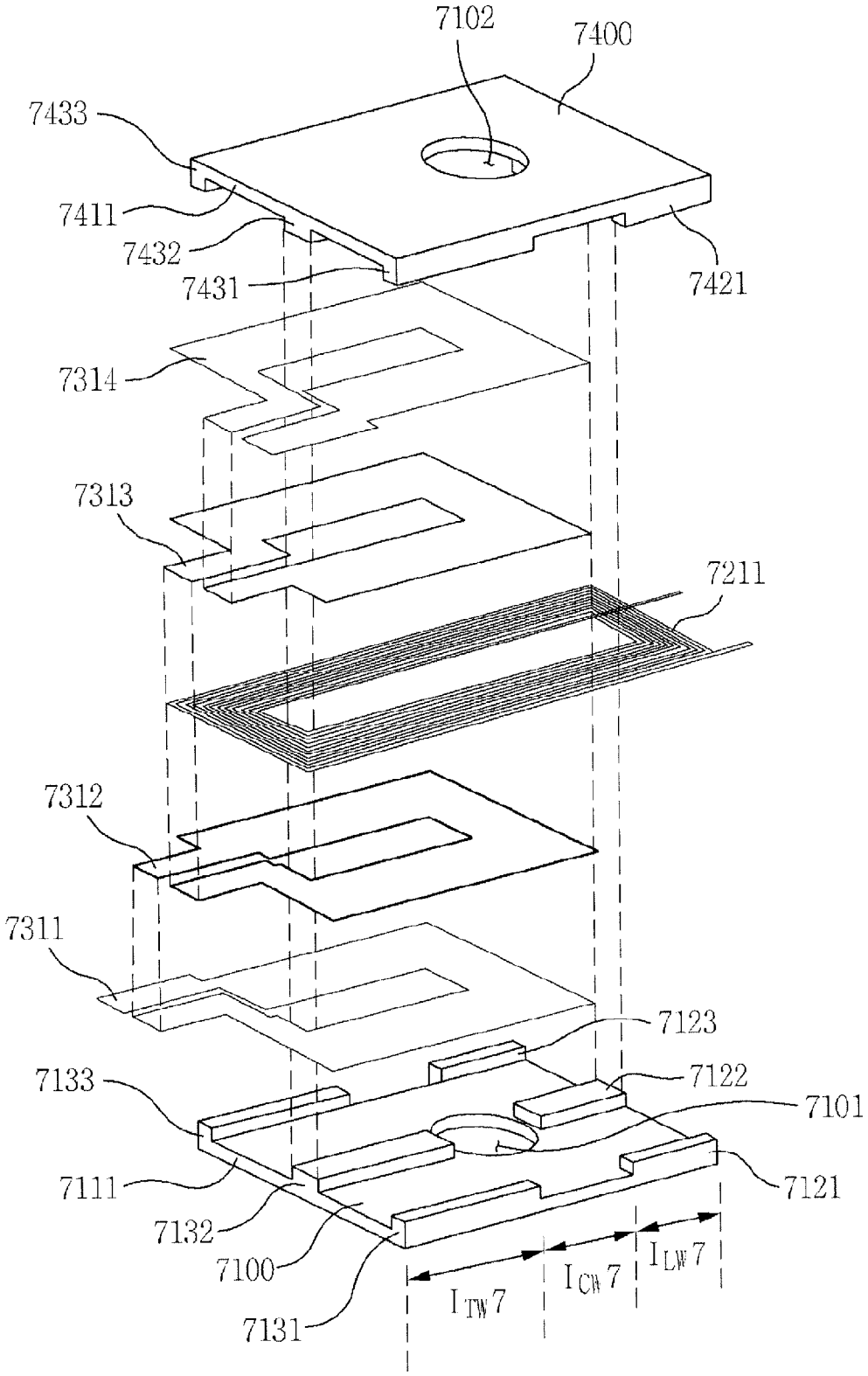
FIG. 16 is an exploded perspective view of a planar transformer according to a seventh embodiment of the present invention.
Figure 17:
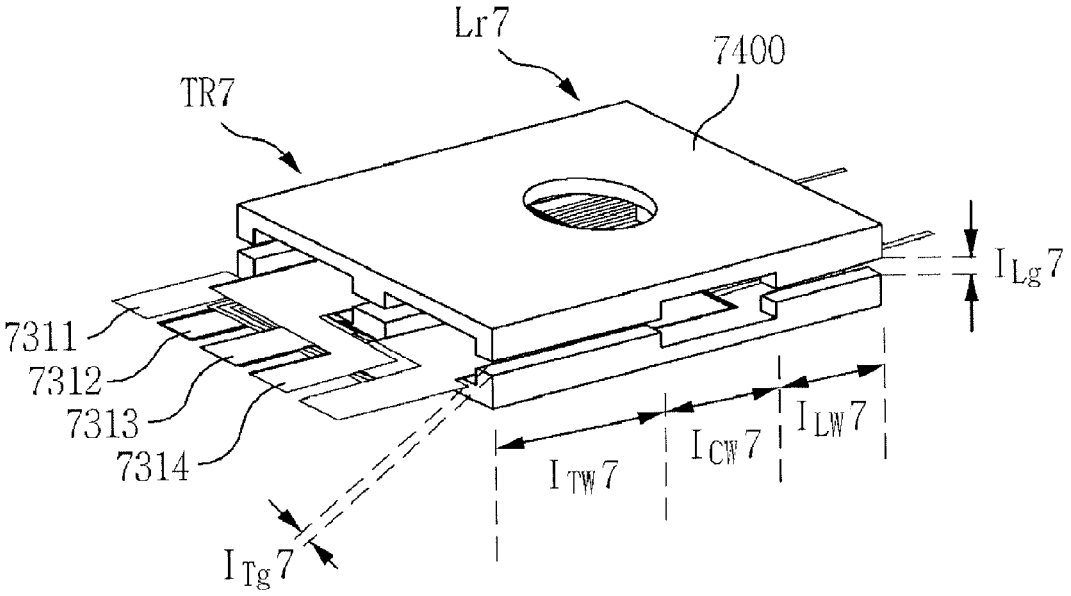
FIG. 17 is a perspective view of the planar transformer according to the seventh embodiment of the present invention.

Hereinafter, a planar transformer according to a seventh embodiment of the present invention will be described with reference to FIGS. 16 and 17. FIG. 16 is an exploded perspective view of a planar transformer according to a seventh embodiment of the present invention, and FIG. 17 is a perspective view of the planar transformer according to the seventh embodiment of the present invention.

As shown in FIG. 16, a first planar core 7100 includes a first main body 7111 which is formed of a rectangular magnetic substance, a first rear sill 7133 which is formed to be extended at a left rear long side of the first main body 7111, a second rear sill 7123 which is formed to be extended at a right rear long side of the first main body 7111, a first front sill 7131 which is formed to be extended at a left front long side of the first main body 7111, a second front sill 7121 which is formed to be extended at a right front long side of the first main body 7111, a first left sill 7132 which is formed at a center portion between the first rear sill 7133 and the first front sill 7131 so as to have a desired length, a first right sill 7122 which is formed at a center portion between the second rear sill 7123 and the second front sill 7121 so as to have a desired length and also which is spaced apart from the first left sill 7132, and a first vent hole 7101 which is formed between the first left sill 7132 and the first right sill 7122 and through which air is ventilated to an outside. In the first planar core 7100, the first rear sill 7133, the second rear sill 7123, the first front sill 7131, the second front sill 7121, the first left sill 7132 and the first right sill 7122 may be integrally formed with the first main body 1111. Meanwhile, the first main body 7111 may be formed of various-shaped magnetic substances such as a rectangular magnetic substance, a square magnetic substance, an elliptical magnetic substance and a circular magnetic substance according to electronic products in which the first main body 7111 is used.

A lower secondary winding 7311, 7312 formed by stacking a plurality of coils is disposed to enclose the first left sill 7132 of the first planar core 7100 between the first rear sill 7133 and the first front sill 7131 of the first planar core 7100.

A primary winding 7211 formed into a rectangular shape having a plurality of wound coils is disposed on the lower secondary winding 7311, 7312 so as to enclose the first left and right sills 7132 and 7122 of the first planar core 7100.

An upper secondary winding 7313, 7314 formed by stacking a plurality of coils is disposed on the primary winding 7211 to enclose the first left sill 7132 of the first planar core 7100.

A second planar core 7400 is disposed on the upper secondary winding 7313, 7314. The second planar core 7400 includes a second main body 7411 which is formed of a rectangular magnetic substance, a third rear sill 7433 which is formed to be extended at a left rear long side of the second main body 7411, a fourth rear sill 7423 which is formed to be extended at a right rear long side of the second main body 7411, a third front sill 7431 which is formed to be extended at a left front long side of the second main body 7411, a fourth front sill 7421 which is formed to be extended at a right front long side of the second main body 7411, a second left sill 7432 which is formed at a center portion between the third rear sill 7433 and the third front sill 7431 so as to have a desired length, a second right sill 7422 which is formed at a center portion between the fourth rear sill 7423 and the fourth front sill 7421 so as to have a desired length and also which is spaced apart from the second left sill 7432, and a second vent hole 7402 which is formed between the second left sill 7432 and the second right sill 7422 and through which air is ventilated to an outside. In the second planar core 7400, the third rear sill 7433, the fourth rear sill 7423, the third front sill 7431, the fourth front sill 7421, the second left sill 7432 and the second right sill 7422 may be integrally formed with the second main body 7411. Meanwhile, the second main body 7411 may be formed of various-shaped magnetic substances such as a rectangular magnetic substance, a square magnetic substance, an elliptical magnetic substance and a circular magnetic substance according to electronic products in which the second main body 7411 is used.

Herein, the first vent hole 7101 of the first planar core 7100 and the second vent hole 7402 of the second planar core 7400 are disposed to be opposed to each other. As the need arises, only one of the first vent hole 7101 of the first planar core 7100 and the second vent hole 7402 of the second planar core 7400, or both of them may be provided.

In the planar transformer according to the seventh embodiment of the present invention, as shown in FIG. 17, a transformer TR7 is formed at an overlapped portion of the first planar core 7100, the lower secondary winding 7311, 7312, the primary winding 7211, the upper second winding 7313, 7314 and the second planar core 7400, and a leakage inductor Lr7 is formed at an overlapped portion of the first planar core 7100, the primary winding 7211 and the second planar core 7400.

On the other hand, it is necessary to insulate between the first planar core 7100 and the lower secondary winding 7311, 7312, between the lower secondary winding 7311, 7312 and the primary winding 7211, between the primary winding 7211 and the upper secondary winding 7313, 7314, between the upper secondary winding 7313, 7314 and the second planar core 7400, and between the primary winding 7211 and the second planar core 7400.

As described above, because the leakage inductor Lr7 is formed at a portion that the lower secondary winding 7311, 7312 or the upper secondary winding 7313, 7314 is not interlinked with the primary winding 7211, the planar transformer according to the seventh embodiment of the present invention does not need to use a separate core having a small magnetic permeability or to provide a separate leakage inductor at the outside thereof.

Moreover, since it is possible to adjust a surface area of the portion that the lower secondary winding 7311, 7312 or the upper secondary winding 7313, 7314 is not interlinked with the primary winding 7211 and thus control a leakage inductance of the leakage inductor Lr7, the planar transformer according to the seventh embodiment of the present invention can secure a sufficient leakage inductance therein.

More detailedly, it is possible to adjust an inductance of the leakage inductor Lr7 by controlling a length of the second front sill 7121, the first right sill 7122 or the second rear sill 7123 of the first planar core 7100.

Meanwhile, it is also possible to efficiently discharge heat generated in the planar transformer by controlling a length lcw7 between the first front sill 7131 of the first planar core 7100 and the second front sill 7121 of the first planar core 7100 or a length between the first rear sill 7133 of the first planar core 7100 and the second rear sill 7123 of the first planar core 7100.

Accordingly, by controlling the length lcw7 between the first front sill 7131 of the first planar core 7100 and the second front sill 7121 of the first planar core 7100 to be the same as the length between the first rear sill 7133 of the first planar core 7100 and the second rear sill 7123 of the first planar core 7100, it is possible to efficiently discharge the heat generated in the planar transformer.

Furthermore, by controlling a length between the third front sill 7431 of the second planar core 7400 and the fourth front sill 7421 of the second planar core 7400 to be the same as the length between the third rear sill 7433 of the second planar core 7400 and the fourth rear sill 7423 of the second planar core 7400, it is possible to further efficiently discharge the heat generated in the planar transformer.

Meanwhile, in the planar transformer according to the seventh embodiment of the present invention, the heat generated therein can be also facilely discharged through the first vent hole 7101 of the first planar core 7100 or the second vent hole 7402 of the second planar core 7400.

The first and second planar cores 7100 and 7400 may be disposed so that the first front sill 7131 of the first planar core 7100 and the third front sill 7431 of the second planar core 7400 are spaced apart from each other at a desired distance. A leakage inductance of the transformer TR7 can be controlled by adjusting the distance ITg7 between the first front sill 7131 of the first planar core 7100 and the third front sill 7431 of the second planar core 7400.

Further, the first and second planar cores 7100 and 7400 may be disposed so that the first rear sill 7133 of the first planar core 7100 and the third rear sill 7433 of the second planar core 7400 are spaced apart from each other at a desired distance. The leakage inductance of the transformer TR7 can be controlled by adjusting the distance between the first rear sill 7133 of the first planar core 7100 and the third rear sill 7433 of the second planar core 7400.

Herein, the first and second planar cores 7100 and 7400 may be disposed so that the second front sill 7121 of the first planar core 7100 and the fourth front sill 7421 of the second planar core 7400 are spaced apart from each other at a desired distance. A leakage inductance of the leakage inductor Lr1 can be controlled by adjusting the distance ILg7 between the second front sill 7121 of the first planar core 7100 and the fourth front sill 7421 of the second planar core 7400.

Further, the first and second planar cores 7100 and 7400 may be disposed so that the second rear sill 7123 of the first planar core 7100 and the fourth rear sill 7423 of the second planar core 7400 are spaced apart from each other at a desired distance. The leakage inductance of the leakage inductor Lr7 can be controlled by adjusting the distance between the second rear sill 7123 of the first planar core 7100 and the fourth rear sill 7423 of the second planar core 7400.

As shown in FIG. 16, the first left sill 7132 or the first right sill 7122 of the first planar core 7100, or the second left sill 7432 or the second right sill 7422 of the second planar core 7400 may be formed into a rectangular shape.

Figure 18:
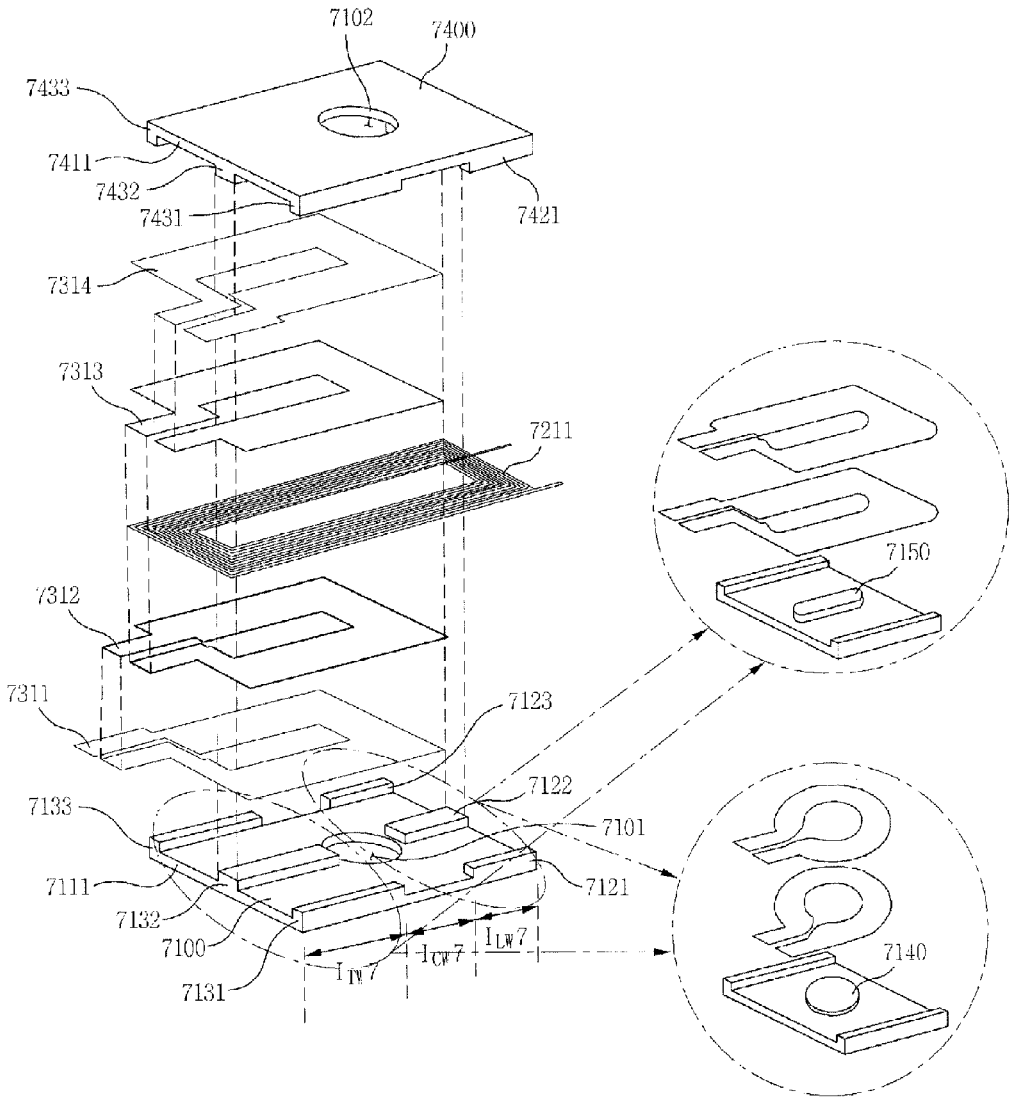
FIG. 18 is an exploded perspective view showing a modified embodiment of the planar transformer according to the seventh embodiments of the present invention.

Meanwhile, as shown in FIG. 18, the first left sill 7132 or the first right sill 7122 of the first planar core 7100 may be formed into an elliptical shape 7150 or a circular shape 7140. The lower secondary winding 7311, 7312, the upper secondary winding 7313, 7314 or the primary winding 7211 may be changed into various shapes according to the shape of the first left sill 7132 or the first right sill 7122.

The second left sill 7432 or the second right sill 7422 of the second planar core 7400 may be also formed into an elliptical or circular shape.

Although various embodiments are provided herein in order to explain the principles, the present invention is not limited to these embodiments.

INDUSTRIAL APPLICABILITY

In the planar transformer according to the embodiments of the present invention, as described above, since it is possible to effectively secure and control the surface area of the portion that the secondary winding is not interlinked with the primary winding, it can secure a sufficient leakage inductance therein without using a separate core having a small magnetic permeability or providing a separate leakage inductor at the outside thereof.

While the present invention has been described with respect to the specific embodiments, it will be apparent to those skilled in the art that various changes and modifications may be made without departing from the spirit and scope of the invention as defined in the following claims.

What is claimed is:

1. A planar transformer, comprising:

a first planar core including a first main body which is formed of a magnetic substance, a first rear sill which is formed at a left rear long side of the first main body, a second rear sill which is formed at a right rear long side of the first main body, a first front sill which is formed at a left front long side of the first main body, a second front sill which is formed at a right front long side of the first main body, a first left sill which is formed at a center portion between the first rear sill and the first front sill, and a first right sill which is formed at a center portion between the second rear sill and the second front sill so as to be spaced apart from the first left sill;

a lower secondary winding which is disposed to enclose the first left sill of the first planar core between the first rear sill and the first front sill of the first planar core;

a primary winding which is disposed on the lower secondary winding so as to enclose the first left and right sills of the first planar core;

an upper secondary winding which is disposed on the primary winding to enclose the first left sill of the first planar core; and a second planar core including a second main body disposed on the upper secondary winding, wherein the first rear sill is spaced apart from the second rear sill, the first front sill is spaced apart from the second front sill, and the first left sill is spaced apart from the first right sill;

wherein the first rear sill, the second rear sill, the first front sill, the second front sill, the first left sill, and the second right sill are formed on the first main body; and wherein the first planar core comprises a first vent hole on the first main body.

2. The planar transformer according to claim 1, wherein the second planar core comprises a second main body which is formed of a magnetic substance, a third rear sill which is formed at a left rear long side of the second main body, a fourth rear sill which is formed at a right rear long side of the second main body, a third front sill which is formed at a left front long side of the second main body, a fourth front sill which is formed at a right front long side of the second main body, a second left sill which is formed at a center portion between the third rear sill and the third front sill, and a second right sill which is formed at a center portion between the fourth rear sill and the fourth front sill so as to be spaced apart from the second left sill.

3. The planar transformer according to claim 2, wherein the first rear sill, the second rear sill, the first front sill, the second front sill, the first left sill and the first right sill of the first planar core are integrally formed with the first main body, and the third rear sill, the fourth rear sill, the third front sill, the fourth front sill, the second left sill and the second right sill of the second planar core are integrally formed with the second main body.

4. The planar transformer according to claim 2, wherein a length between the first front sill of the first planar core and the second front sill of the first planar core is the same as a length between the first rear sill of the first planar core and the second rear sill of the first planar core, and a length between the third front sill of the second planar core and the fourth front sill of the second planar core is the same as a length between the third rear sill of the second planar core and the fourth rear sill of the second planar core.

5. The planar transformer according to claim 2, wherein the first front sill of the first planar core and the second front sill of the first planar core are connected to each other, and the first rear sill of the first planar core and the second rear sill of the first planar core are connected to each other.

6. The planar transformer according to claim 2, wherein the first left sill and the first right sill of the first planar core, and the second left sill and the second right sill of the second planar core are formed into one of rectangular shape, circle shape, and elliptical shape.

7. The planar transformer according to claim 2, wherein the first front sill of the first planar core and the third front sill of the second planar core, and the first rear sill of the first planar core and the third rear sill of the second planar core are spaced apart from each other at a desired distance, and wherein the second front sill of the first planar core and the fourth front sill of the second planar core, and the second rear sill of the first planar core and the fourth rear sill of the second planar core are spaced apart from each other at a desired distance.

8. The planar transformer according to claim 1, wherein the second planar core comprises;

a second left planar core corresponding to the first rear sill and the first front sill of the first planar core; and a second right planar core corresponding to the second rear sill and the second front sill of the first planar core, wherein the second left planar core and the second right planar core are apart from each other.

9. The planar transformer according to claim 1, wherein the second planar core comprises a second vent hole corresponding to the first vent hole.

10. The planar transformer according to claim 9, wherein first vent hole is formed between the first left sill and the first right sill and through which air is ventilated to an outside.

11. The planar transformer according to claim 1, wherein the lower secondary winding, the upper secondary winding or the primary winding have various shapes according to the shape of the first left sill or the first right sill.

12. A planar transformer, comprising:

a first planar core including a first main body which is formed of a magnetic substance, a first rear sill which is formed at a left rear long side of the first main body, a second rear sill which is formed at a right rear long side of the first main body, a first front sill which is formed at a left front long side of the first main body, a second front sill which is formed at a right front long side of the first main body, a first left sill which is formed at a center portion between the first rear sill and the first front sill, and a first right sill which is formed at a center portion between the second rear sill and the second front sill so as to be spaced apart from the first left sill;

a lower secondary winding which is disposed to enclose the first left sill of the first planar core between the first rear sill and the first front sill of the first planar core;

a primary winding which is disposed on the lower secondary winding so as to enclose the first left and right sills of the first planar core;

an upper secondary winding which is disposed on the primary winding to enclose the first left sill of the first planar core; and a second planar core including a second main body which have a flat type, and disposed on the upper secondary winding, wherein the first rear sill is spaced apart from the second rear sill, the first front sill is spaced apart from the second front sill, and the first left sill is spaced apart from the first right sill;

wherein the first rear sill, the second rear sill, the first front sill, the second front sill, the first left sill, and the second right sill are formed on the first main body; and wherein the first planar core comprises a first vent hole on the first main body.

13. The planar transformer according to claim 12, wherein the first rear sill, the second rear sill, the first front sill, the second front sill, the first left sill and the first right sill of the first planar core are integrally formed with the first main body.

14. The planar transformer according to claim 12, wherein a length between the first front sill of the first planar core and the second front sill of the first planar core is the same as a length between the first rear sill of the first planar core and the second rear sill of the first planar core.

15. The planar transformer according to claim 12, wherein the first left sill and the first right sill of the first planar core are formed into one of rectangular shape, circle shape, and elliptical shape.

16. The planar transformer according to claim 12, wherein the first front sill of the first planar core and the second planar core, and the first rear sill of the first planar core and the second planar core are spaced apart from each other at a desired.

17. The planar transformer according to claim 12, wherein the second planar core comprises;

a second left planar core corresponding to the first rear sill and the first front sill of the first planar core; and a second right planar core corresponding to the second rear sill and the second front sill of the first planar core, wherein the second left planar core and the second right planar core are apart from each other.

* * * * *